US010994533B2

(12) United States Patent
Yoshida

(10) Patent No.: US 10,994,533 B2
(45) Date of Patent: May 4, 2021

(54) LIQUID DISCHARGE DEVICE AND LIQUID DISCHARGE APPARATUS

(71) Applicant: Takahiro Yoshida, Kanagawa (JP)

(72) Inventor: Takahiro Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/356,021

(22) Filed: Mar. 18, 2019

(65) Prior Publication Data

US 2019/0283414 A1 Sep. 19, 2019

(30) Foreign Application Priority Data

Mar. 19, 2018 (JP) ..... JP2018-051820
Jan. 28, 2019 (JP) ..... JP2019-012325
Mar. 14, 2019 (JP) ..... JP2019-047409

(51) Int. Cl.
*B41J 2/045* (2006.01)
*B41J 2/14* (2006.01)

(52) U.S. Cl.
CPC ..... *B41J 2/04588* (2013.01); *B41J 2/04563* (2013.01); *B41J 2/04566* (2013.01);
(Continued)

(58) Field of Classification Search
CPC ..... B41J 2/04581; B41J 2/04593; B41J 2/04588; B41J 2/04596; B41J 2/14274;
(Continued)

(56) References Cited

U.S. PATENT DOCUMENTS

2007/0211092 A1 9/2007 Shingyohuchi et al.
2009/0289975 A1 11/2009 Yoshida
(Continued)

FOREIGN PATENT DOCUMENTS

JP 2000-255056 9/2000
JP 2001-270132 10/2001
(Continued)

*Primary Examiner* — Jannelle M Lebron
(74) *Attorney, Agent, or Firm* — Harness, Dickey & Pierce, P.L.C.

(57) ABSTRACT

A liquid discharge device includes a liquid discharge head including a plurality of liquid chambers respectively communicating with a plurality of nozzles and circulating liquid therethrough. Each liquid chamber is provided with a pressure generator for discharging the liquid from a corresponding nozzle. The liquid discharge device further includes a waveform data memory to store drive waveform data including discharge drive waveform data for discharging the liquid according to image data and micro-vibration drive waveform data for causing a micro vibration of a meniscus of the liquid discharge head. The liquid discharge device further includes circuitry configured to generate a drive waveform based on the drive waveform data; apply, to the pressure generator, a discharge drive waveform based on the discharge drive waveform data, in a printing area; and apply, to the pressure generator, a micro-vibration drive waveform based on the micro-vibration drive waveform data, in a non-print area.

9 Claims, 18 Drawing Sheets

(52) U.S. Cl.
CPC ..... *B41J 2/04573* (2013.01); *B41J 2/04581* (2013.01); *B41J 2/04593* (2013.01); *B41J 2/04596* (2013.01); *B41J 2/14274* (2013.01); *B41J 2002/14403* (2013.01); *B41J 2202/12* (2013.01)

(58) Field of Classification Search
CPC ..... B41J 2002/14403; B41J 2202/12; B41J 2/04563; B41J 2/04566; B41J 2/04573; B41J 2/175
See application file for complete search history.

(56) References Cited

U.S. PATENT DOCUMENTS

| | | | | |
|---|---|---|---|---|
| 2011/0096113 | A1 | 4/2011 | Yoshida | |
| 2014/0218428 | A1 | 8/2014 | Araki et al. | |
| 2014/0285554 | A1 | 9/2014 | Yanaka et al. | |
| 2015/0035883 | A1* | 2/2015 | Fukuda | B41J 2/04588 347/10 |
| 2015/0062255 | A1 | 3/2015 | Sasaki | |
| 2015/0246533 | A1 | 9/2015 | Nemoto et al. | |
| 2015/0375504 | A1 | 12/2015 | Kitaoka et al. | |
| 2016/0185113 | A1 | 6/2016 | Yoshida et al. | |

FOREIGN PATENT DOCUMENTS

| | | | |
|---|---|---|---|
| JP | 2003-034019 | | 2/2003 |
| JP | 2006035568 | A * | 2/2006 |
| JP | 2008-290292 | | 12/2008 |
| JP | 2013-121665 | | 6/2013 |
| JP | 2015-071289 | | 4/2015 |
| JP | 2017-132982 | | 8/2017 |

* cited by examiner

LIQUID DISCHARGE DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2018-051820 filed on Mar. 19, 2018, 2019-012325, filed on Jan. 28, 2019, and 2019-047409, filed on Mar. 14, 2019, in the Japan Patent Office, the entire disclosure of each of which is hereby incorporated by reference herein.

BACKGROUND

Technical Field

The present disclosure relates to a liquid discharge apparatus and a liquid discharge device.

Description of the Related Art

As one type of liquid (liquid droplet) discharge heads to discharge liquid, there is a circulation-type head in which liquid is circulated through a plurality of individual liquid chambers.

For example, in a circulation-type liquid discharge head, a channel substrate (for example, constructed of a plurality of plates) defines a common liquid chamber from which liquid is supplied to the individual liquid chambers that generate pressure (pressure generation chambers), a common circulation chamber communicating with circulation channels respectively communicating with the individual liquid chambers.

It is known to slightly vibrate a meniscus of liquid at a nozzle of the liquid discharge head, to such degree that the liquid is not discharged therefrom, to protect the meniscus from drying.

SUMMARY

According to an embodiment of this disclosure, a liquid discharge device includes a liquid discharge head including a plurality of liquid chambers communicating with a plurality of nozzles, respectively, and a waveform data memory configured to store drive waveform data. Through the plurality of liquid chambers, liquid is circulated, and each of the plurality of liquid chambers is provided with a pressure generator configured to generate a pressure to discharge the liquid from corresponding one of the plurality of nozzles. The drive waveform data includes discharge drive waveform data for discharging, in a printing area, the liquid according to image data; and micro-vibration drive waveform data for causing, in a non-print area, a micro vibration of a meniscus of the liquid discharge head, the non-print area outside the printing area. The liquid discharge device further includes circuitry configured to generate a drive waveform based on the drive waveform data; apply, to the pressure generator, a discharge drive waveform generated based on the discharge drive waveform data, in the printing area; and apply, to the pressure generator, a micro-vibration drive waveform generated based on the micro-vibration drive waveform data, in the non-print area.

Another embodiment provides a liquid discharge apparatus that includes a conveyance device configured to convey a recording medium, and the liquid discharge device described above. The liquid discharge device discharges the liquid onto the recording medium conveyed by the conveyance device, to form an image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
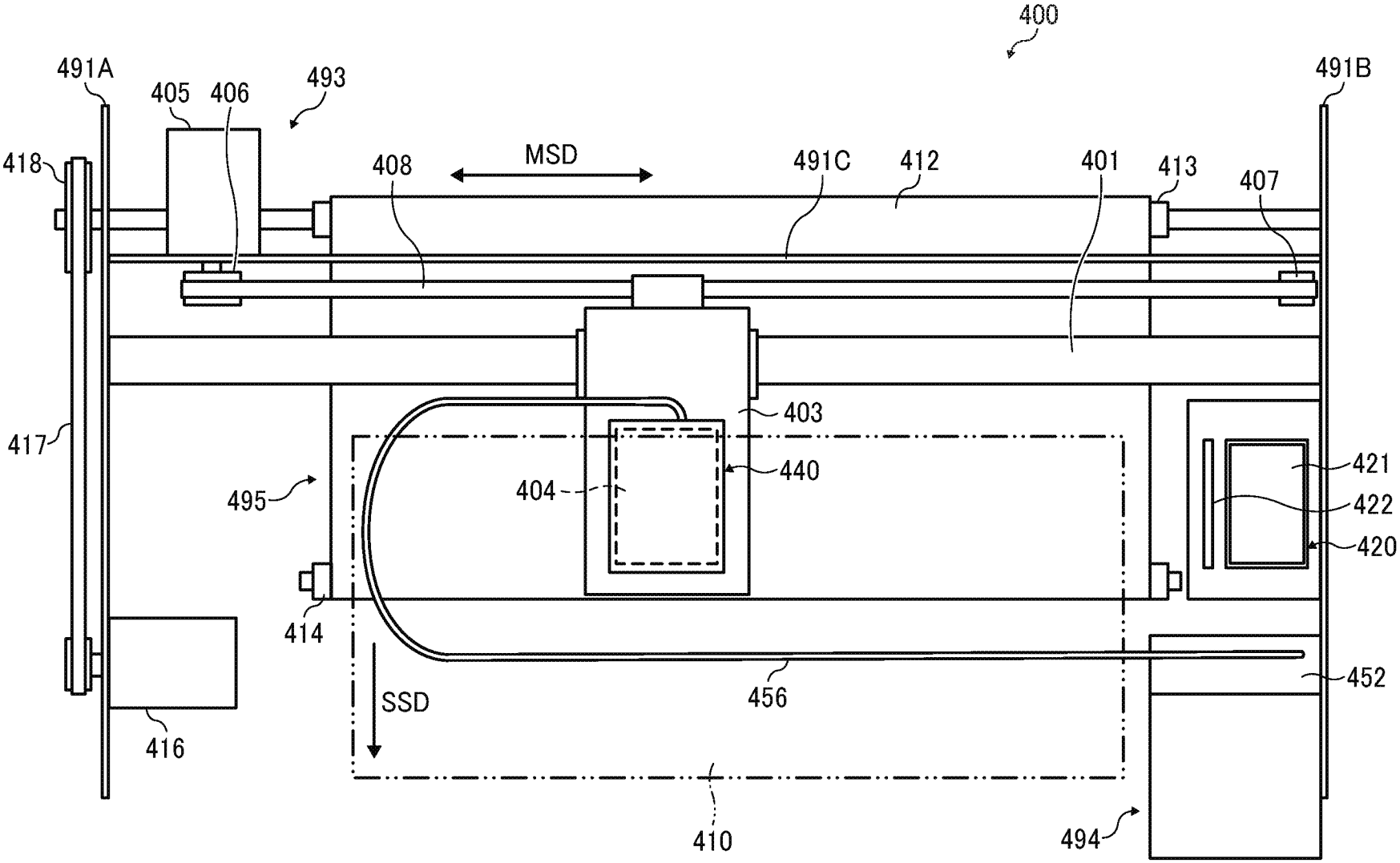
FIG. 1 is a plan view schematically illustrating a configuration of a liquid discharge apparatus according to Embodiment 1.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, liquid discharge devices and liquid discharge apparatuses according to embodiments of this disclosure is described. As used herein, the singular forms "a", "an", and "the" are intended to include the plural forms as well, unless the context clearly indicates otherwise.

Embodiment 1

Figure 2:
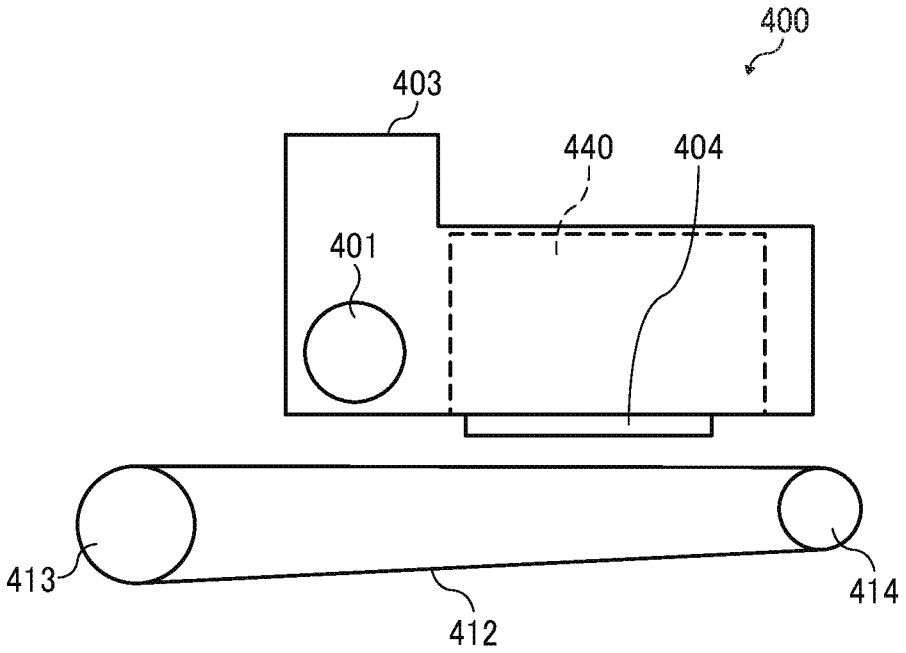
FIG. 2 is a side view schematically illustrating a configuration of the liquid discharge apparatus illustrated in FIG. 1.

FIG. 1 is a plan view schematically illustrating a configuration of a liquid discharge apparatus 400 according to Embodiment 1. FIG. 2 is a side view schematically illustrating the configuration of the liquid discharge apparatus 400.

The liquid discharge apparatus 400 is a serial-type image recording apparatus and includes a carriage 403 and a main-scan moving unit 493 to reciprocally move the carriage 403 in a main scanning direction indicated by arrow MSD. The main-scan moving unit 493 includes, for example, a guide 401, a main scanning motor 405, and a timing belt 408. The guide 401 is bridged between a left side plate 491A and a right side plate 491B and holds the carriage 403 movably. The timing belt 408 is looped between a driving pulley 406 and a driven pulley 407. Rotated by the main scanning motor 405, the timing belt 408 reciprocally moves the carriage 403 in the main scanning direction.

On the carriage 403, a liquid discharge device 440 (a liquid discharge unit) including a liquid discharge head 404 according to an embodiment of the present disclosure is mounted. The liquid discharge head 404 of the liquid discharge device 440 discharges liquid of different colors, for example, yellow (Y), cyan (C), magenta (M), and black (K). The liquid discharge head 404 includes nozzle arrays each including a plurality of nozzles 4 (see FIG. 7) lined in a sub-scanning direction indicated by arrow SSD, which is perpendicular to the main scanning direction. The liquid discharge head 404 is mounted on the carriage 403 so that ink droplets are discharged downward.

The liquid discharge apparatus 400 includes a supply and circulation system 494 to supply the liquid stored outside the liquid discharge head 404 to the liquid discharge head 404. The supply and circulation system 494 supplies the liquid into the liquid discharge head 404 and circulates the liquid therein.

The supply and circulation system 494 will be described in detail.

Figure 3:
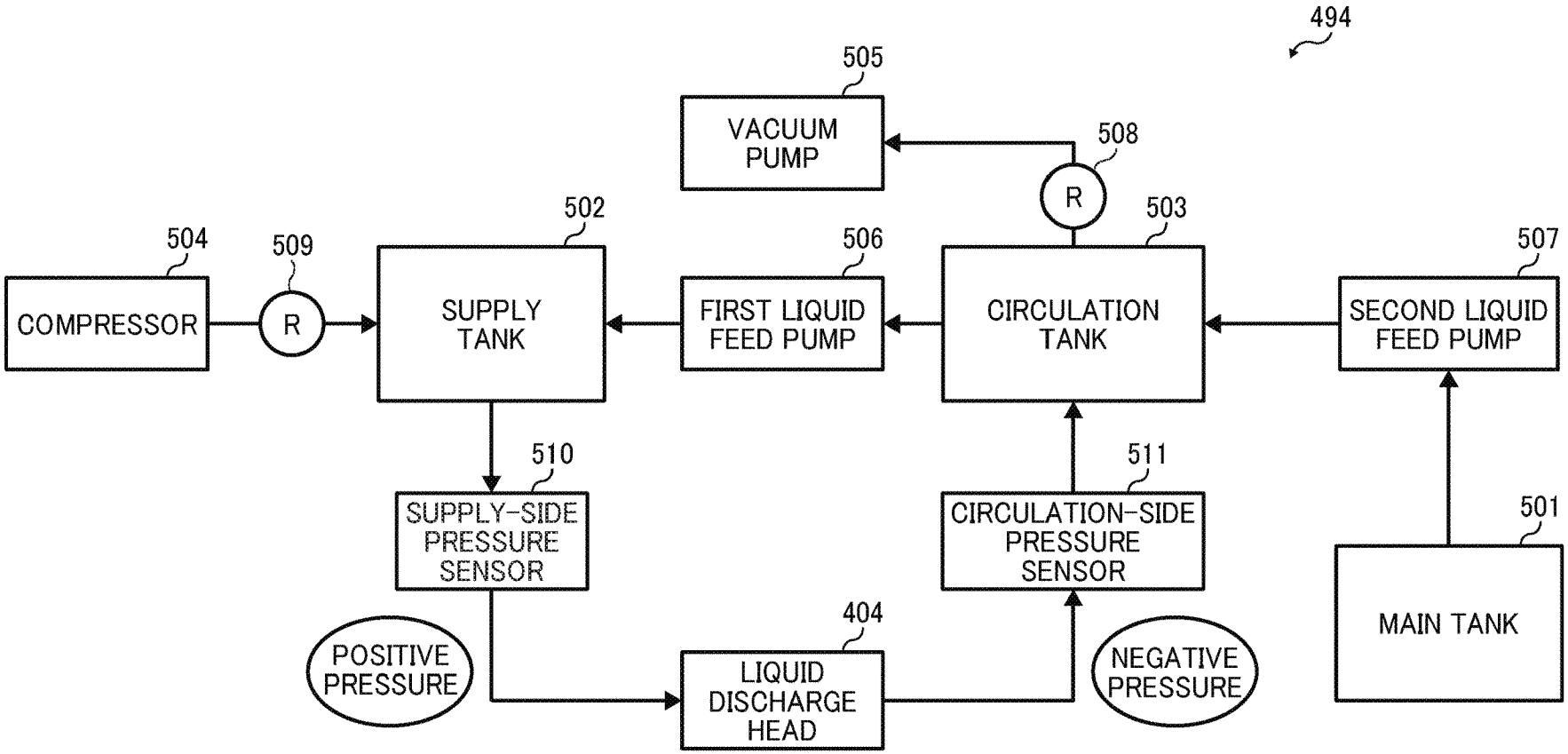
FIG. 3 is a block diagram illustrating an example configuration of a supply and circulation system in the liquid discharge apparatus illustrated in FIG. 1.

FIG. 3 is a block diagram illustrating an example of the supply and circulation system 494. As illustrated in FIG. 3, the supply and circulation system 494 includes, for example, a main tank 501, the liquid discharge head 404, a supply tank 502, a circulation tank 503, a compressor 504, a vacuum pump 505, a first liquid feed pump 506, a second liquid feed pump 507, regulators 508 and 509, a supply-side pressure sensor 510, and a circulation-side pressure sensor 511. The supply-side pressure sensor 510 is disposed between the supply tank 502 and the liquid discharge head 404 and coupled to a supply channel, which is coupled to a supply port 71 (see FIG. 4) of the liquid discharge head 404. The circulation-side pressure sensor 511 is disposed between the liquid discharge head 404 and the circulation tank 503 and is coupled to the side of the circulation channel, which is coupled to circulation ports 81 (see FIG. 4) of the liquid discharge head 404.

One end of the circulation tank 503 is coupled to the supply tank 502 via the first liquid feed pump 506, and the other end of the circulation tank 503 is coupled to the main tank 501 via the second liquid feed pump 507. Accordingly, the liquid flows from the supply tank 502 into the liquid discharge head 404 via the supply port 71 and exits the liquid discharge head 404 from the circulation ports 81 into the circulation tank 503. Further, the first liquid feed pump 506 feeds the liquid from the circulation tank 503 to the supply tank 502. Thus, the liquid is circulated.

The supply tank 502 is coupled to the compressor 504 and controlled to keep the pressure detected by the supply-side pressure sensor 510 at a predetermined positive pressure. The circulation tank 503 is coupled to the vacuum pump 505 and controlled to keep the pressure detected by the circulation-side pressure sensor 511 at a predetermined negative pressure. Such a configuration allows the meniscus of liquid to maintain a constant negative pressure while circulating the liquid inside the liquid discharge head 404.

As the liquid discharge head 404 discharges droplets from the nozzles 4, the amount of liquid in the supply tank 502 and the circulation tank 503 decreases. Accordingly, preferably, the circulation tank 503 is replenished with the liquid fed from the main tank 501 by the second liquid feed pump 507. The timing of replenishment of the circulation tank 503 with the liquid from the main tank 501 can be controlled in accordance with a result of detection with a liquid level sensor in the circulation tank 503. For example, the liquid is supplied to the circulation tank 503 from the main tank 501 in response to a detection result that the liquid level in the circulation tank 503 is lower than a predetermined height.

Returning back to FIGS. 1 and 2, the liquid discharge apparatus 400 includes a conveyance unit 495 (a conveyance device) to convey a sheet 410 as a recording medium. The conveyance unit 495 includes a conveyor belt 412 to convey the sheet 410 and a sub-scanning motor 416 to drive the conveyor belt 412.

The conveyor belt 412 attracts the sheet 410 and conveys the sheet 410 at a position facing the liquid discharge head 404. The conveyor belt 412 is an endless belt and is stretched between a conveyance roller 413 and a tension roller 414. The sheet 410 can be attracted to the conveyor belt 412 by electrostatic attraction, air suction, or the like.

As the conveyance roller 413 is rotated by the sub-scanning motor 416 via a timing belt 417 and a timing pulley 418, the conveyor belt 412 rotates in the sub-scanning direction SSD.

The liquid discharge apparatus 400 further includes a maintenance unit 420 at one side in the main scanning direction MSD of the carriage 403 and on a lateral side of the conveyor belt 412. The maintenance unit 420 maintains and recovers the liquid discharge head 404 in good condition.

The maintenance unit 420 includes, for example, a cap 421 to cap a nozzle face (a face provided with the nozzles 4) of the liquid discharge head 404 and a wiper 422 to wipe the nozzle face.

The main-scan moving unit 493, the supply and circulation system 494, the maintenance unit 420, and the conveyance unit 495 are mounted to a housing that includes the left side plate 491A, the right side plate 491B, and a rear side plate 491C.

In the liquid discharge apparatus 400 thus configured, the sheet 410 is fed to the conveyor belt 412, attracted thereunto, and conveyed in the sub-scanning direction SSD as the conveyor belt 412 rotates.

While the carriage 403 moves in the main scanning direction MSD, the liquid discharge head 404 is driven in response to image signals, to discharge the liquid to the sheet 410 kept stationary. Thus, the liquid discharge apparatus 400 forms an image on the sheet 410.

Next, the liquid discharge head 404 will be described in detail.

Figure 4:
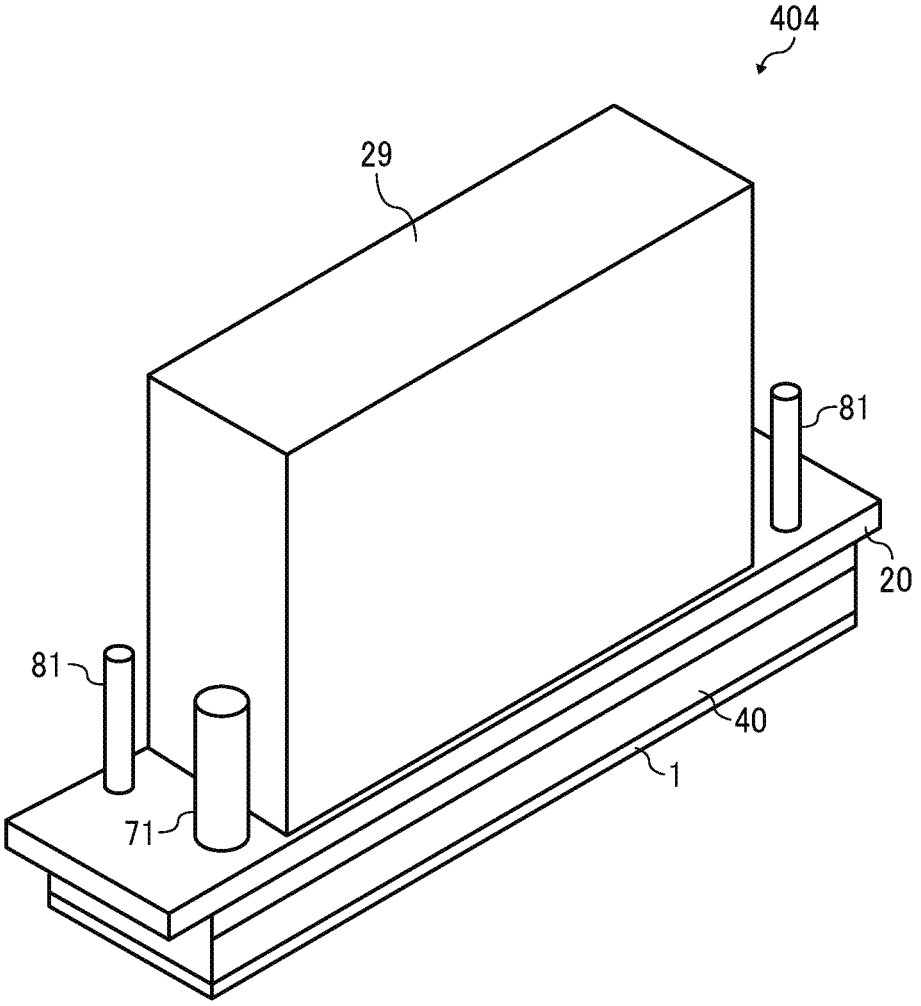
FIG. 4 is an external perspective view of a liquid discharge head of the liquid discharge apparatus illustrated in FIG. 1.
Figure 5:
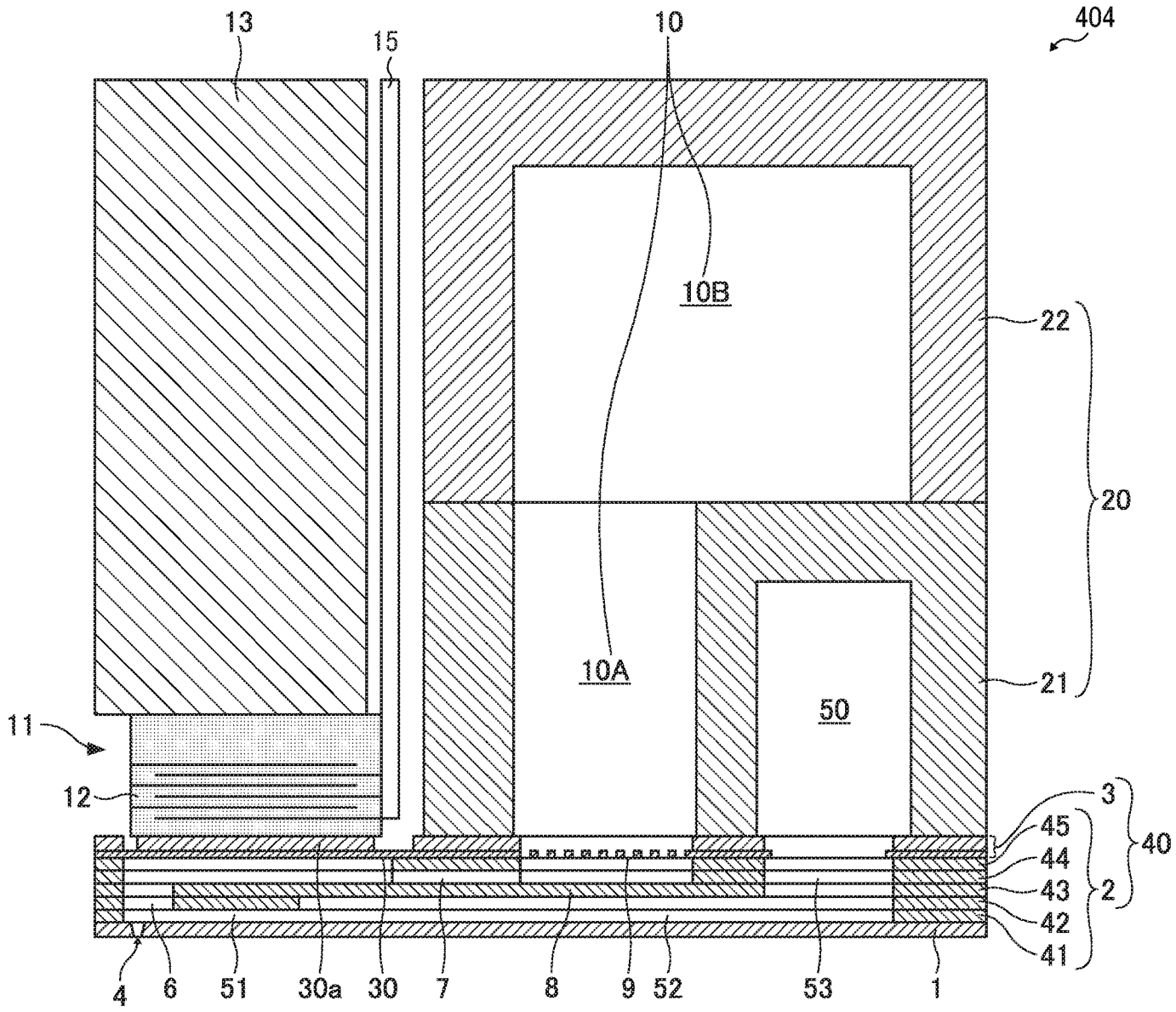
FIG. 5 is a cross-sectional view of the liquid discharge head, cut in a direction perpendicular to a nozzle array direction.
Figure 6:
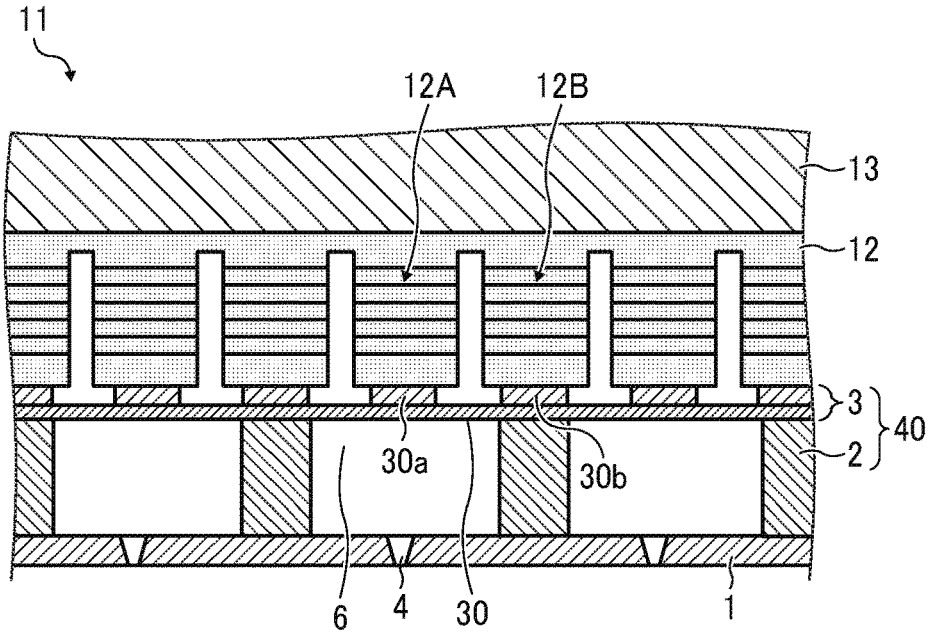
FIG. 6 is a cross-sectional view of the liquid discharge head illustrated in FIG. 5, in a direction parallel to the nozzle array direction.
Figure 7:
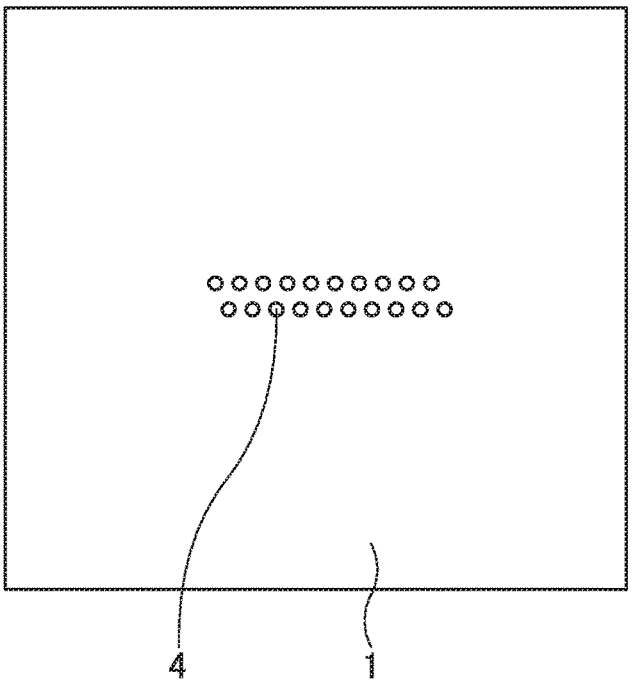
FIG. 7 is a plan view illustrating a nozzle plate of the liquid discharge head.

FIG. 4 is an external perspective view of the liquid discharge head 404. FIG. 5 is a cross-sectional view of the liquid discharge head 404, cut in the direction perpendicular to a nozzle array direction. FIG. 6 is a cross-sectional view of the liquid discharge head 404, in a direction parallel to the nozzle array direction. FIG. 7 is a plan view illustrating a nozzle plate 1 of the liquid discharge head 404. FIGS. 8A to 8F are plan views illustrating members constructing a channel member 40 in the liquid discharge head 404. FIGS. 9A and 9B are plan views illustrating members constructing a common-chamber substrate 20 of the liquid discharge head 404.

The liquid discharge head 404 illustrated in FIG. 1 includes the nozzle plate 1, the channel substrate 2, and a diaphragm member 3 that are laminated one on another and bonded to each other. The diaphragm member 3 serves as a wall member. Hereinafter, the "liquid discharge head" may be simply referred to as "head". The liquid discharge head 404 includes piezoelectric actuators 11 to displace the diaphragm member 3, the common-chamber substrate 20, and a cover 29.

The nozzle plate 1 includes a plurality of nozzles 4 to discharge liquid.

The channel substrate 2 includes individual liquid chambers 6 communicating with the nozzles 4, fluid restrictors 7 communicating with the individual liquid chambers 6, and liquid introduction portions 8 communicating with the fluid restrictors 7. The channel substrate 2 is formed of a plurality of plates 41 to 45 stacked one on another from the side of the nozzle plate 1. The plates 41 to 45 and the diaphragm member 3 are stacked and joined together into the channel member 40.

The diaphragm member 3 includes a filter portion 9 serving as openings through which the liquid introduction portions 8 communicate with a common chamber 10 defined by the common-chamber substrate 20.

The diaphragm member 3 is a wall member that forms wall faces of the individual liquid chambers 6 of the channel substrate 2. The diaphragm member 3 has, for example, a double-layer structure. The diaphragm member 3 includes a first layer serving a thin portion and a second layer serving as a thick portion from the side of the channel substrate 2. In the diaphragm member 3, the first layer includes deformable vibration portions 30 positioned corresponding to the individual liquid chambers 6.

As illustrated in FIG. 7 as well, the plurality of nozzles 4 is arranged in a staggered pattern on the nozzle plate 1.

Figure 8A:
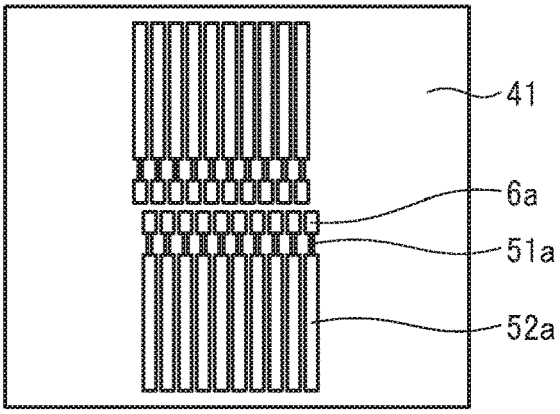
FIGS. 8A to 8F are plan views illustrating components constructing a channel member in the liquid discharge head.
Figure 9A:
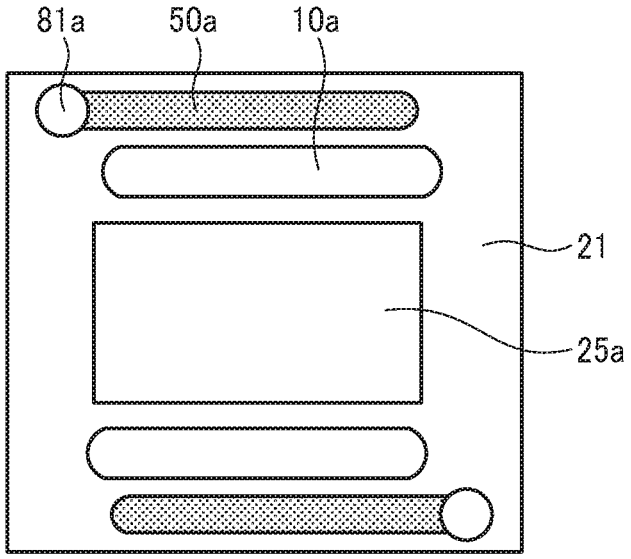
FIGS. 9A and 9B are plan views illustrating components constructing a common-chamber substrate of the liquid discharge head.
Figure 9B:
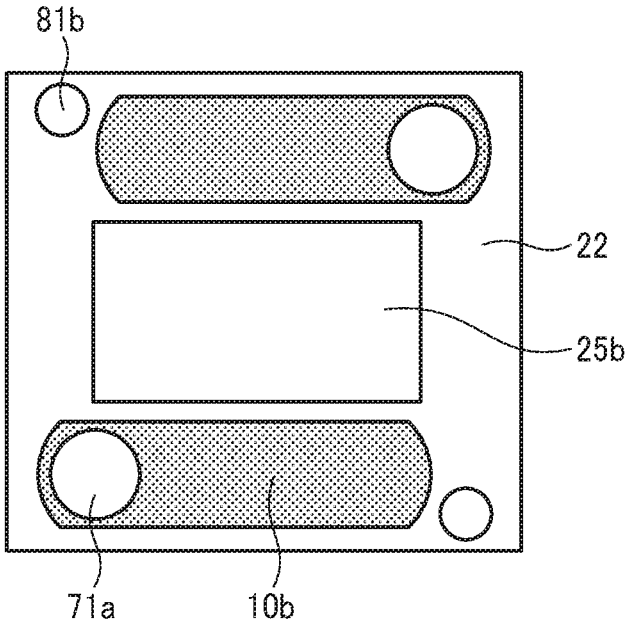

As illustrated in FIG. 8A, the plate 41 forming the channel substrate 2 includes through grooves 6*a* and through grooves 51*a* and 52*a*. The term "through groove" used in the present specification represents a groove-shaped (slot-like) through hole. The through grooves 6*a* serve as the individual liquid chambers 6. The through grooves 51*a* serve as fluid restrictors 51, and the through grooves 52*a* serve as a circulation channel 52.

Figure 8B:
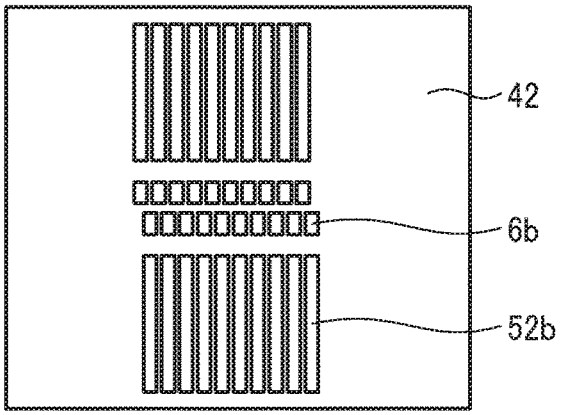

As illustrated in FIG. 8B, the plate 42 includes through grooves 6*b* serving as the individual liquid chambers 6 and through grooves 52*b* serving as the circulation channel 52.

Figure 8C:
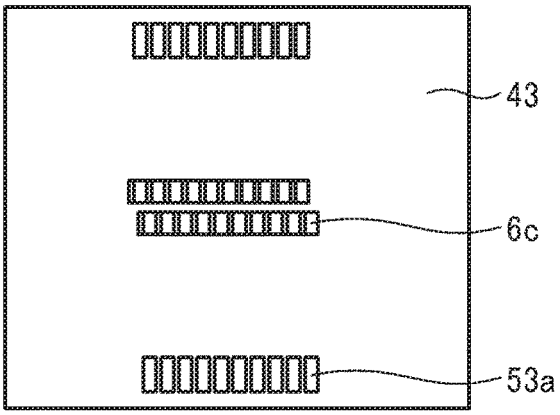

As illustrated in FIG. 8C, the plate 43 includes through grooves 6*c* serving as the individual liquid chambers 6 and through grooves 53*a* serving as a circulation channel 53. The longitudinal direction of the through groove 53*a* is in the nozzle array direction.

Figure 8D:
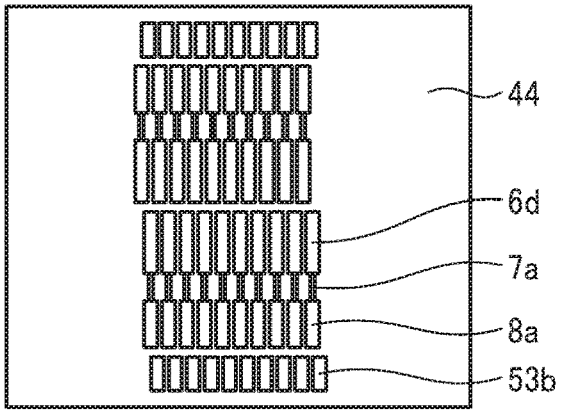

As illustrated in FIG. 8D, the plate 44 includes through grooves 6*d* serving as the individual liquid chambers 6, through grooves 7*a* serving as the fluid restrictors 7, through grooves 8*a* serving as the liquid introduction portions 8, and through grooves 53*b* serving as the circulation channel 53. The longitudinal direction of the through groove 53*b* is in the nozzle array direction.

Figure 8E:
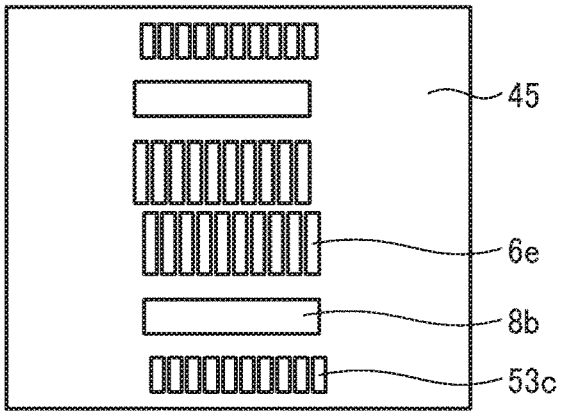

As illustrated in FIG. 8E, the plate 45 includes through grooves 6*e* serving as the individual liquid chambers 6, through grooves 8*b* (post-filter liquid chamber downstream from the filter portion 9) serving as the liquid introduction portion 8, and through grooves 53*c* serving as the circulation channel 53. The longitudinal direction of the through grooves 8*b* and that of the through groove 53*c* are in the nozzle array direction.

Figure 8F:
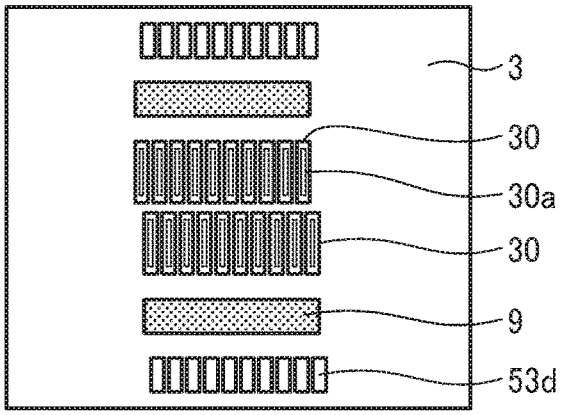

As illustrated in FIG. 8F, the diaphragm member 3 includes the vibration portions 30, the filter portions 9, and through grooves 53*d* serving as the circulation channel 53. The longitudinal direction of the through groove 53*d* is in the nozzle array direction. The vibration portions 30 include projecting portions 30*a*.

Thus, as a plurality of plates (the plates 41 to 45 and the diaphragm member 3) are stacked and bonded together into the channel member 40, a complicated channel can be defined with a simple construction.

With the above-described configuration, the fluid restrictors 51 disposed along the surface of the channel substrate 2 communicating with the individual liquid chambers 6 are formed in the channel member 40 including the channel substrate 2 and the diaphragm member 3. Further, the circulation channel 52 and the circulation channel 53 extending in the thickness direction of the channel member 40 and communicating with the circulation channel 52 are formed in the channel member 40. The circulation channel 53 leads to a common circulation chamber 50 to be described later.

On the other hand, the common-chamber substrate 20 defines the common chamber 10 to which liquid is supplied from the supply and circulation system 494 and the common circulation chamber 50.

As illustrated in FIG. 9A, a first common-chamber member 21 of the common-chamber substrate 20 includes a through hole 25*a* for a piezoelectric actuator, through grooves 10*a* serving as downstream common chamber 10A, and grooves 50*a* serving as the common circulation chamber 50. The grooves 50*a* have bottoms.

As illustrated in FIG. 9B, a second common-chamber member 22 includes a through hole 25*b* for a piezoelectric actuator and grooves 10*b* serving as upstream common chamber 10B.

Referring also to FIG. 4, the second common-chamber member 22 includes through holes 71*a*. The through hole 71*a* serves as a supply inlet through which one end of the common chamber 10 in the nozzle array direction communicates with the supply port 71.

Similarly, the first common-chamber member 21 and the second common-chamber member 22 include through holes 81*a* and 81*b*, respectively, through which the other end (opposite the through holes 71*a*) of the common circulation chamber 50 in the nozzle array direction communicates with the circulation port 81.

Note that, in FIGS. 9A and 9B, a groove having a bottom is indicated with hatching, which is similar in the subsequent drawings.

Thus, the common-chamber substrate 20 includes the first common-chamber member 21 and the second common-chamber member 22. The first common-chamber member 21 is bonded to a side of the channel member 40 facing the diaphragm member 3. The second common-chamber member 22 is laminated on and bonded to the first common-chamber member 21.

The first common-chamber member 21 defines the downstream common chamber 10A and the common circulation chamber 50. The downstream common chamber 10A is a portion of the common chamber 10 communicating with the liquid introduction portion 8. The common circulation chamber 50 communicates with the circulation channel 53. The second common-chamber member 22 defines the upstream common chamber 10B that is a remaining portion of the common chamber 10.

The downstream common chamber 10A, which is a portion of the common chamber 10, and the common circulation chamber 50 are disposed side by side in the direction perpendicular to the nozzle array direction. The common circulation chamber 50 is disposed within the common chamber 10, when being projected.

Such placement is advantageous in that, the size of the common circulation chamber 50 is not restricted by the dimensions required for the channels including the individual liquid chambers 6, the fluid restrictors 7, and the liquid introduction portions 8 defined by the channel member 40.

Owing to the configuration in which the common circulation chamber 50 and a portion of the common chamber 10 are disposed side by side and the common circulation chamber 50 is disposed to be projected inside the common chamber 10, the width of the liquid discharge head 404 can be relatively small in the direction orthogonal to the nozzle array direction. Accordingly, the liquid discharge head 404 can be compact. The common-chamber substrate 20 forms the common chamber 10 and the common circulation chamber 50 to which liquid is supplied from the supply tank 502.

The liquid discharge head 404 further includes the piezoelectric actuator 11 disposed on a side of the diaphragm member 3 opposite a side facing the individual liquid chambers 6. The piezoelectric actuator 11 includes electromechanical transducer elements as drivers (actuators or pressure generators) to deform the vibration portion 30 of the diaphragm member 3.

As illustrated in FIG. 6, the piezoelectric actuator 11 includes piezoelectric members 12 (pressure generators) bonded on a base 13. The piezoelectric members 12 are grooved by half cut dicing so that each piezoelectric member 12 includes a desired number of pillar-shaped piezoelectric elements 12A and 12B arranged at regular intervals into a comb shape.

In the present embodiment, the piezoelectric elements 12A of the piezoelectric member 12 are driven by application of drive waveforms, and the piezoelectric elements 12B are used as supports to which no drive waveform is applied. Alternatively, in some embodiments, all of the piezoelectric elements 12A and 12B may be piezoelectric elements to be driven by application of drive waveforms.

The piezoelectric element 12A is joined to the projecting portion 30*a*, which is an island-shaped thick portion on the vibration portion 30 of the diaphragm member 3. The piezoelectric element 12B is bonded to a projecting portion 30*b*, which is a thick portion of the diaphragm member 3.

The piezoelectric member 12 includes piezoelectric layers and internal electrodes alternately laminated on each other. The internal electrodes are lead out to an end face of the piezoelectric member 12 to form external electrodes. The external electrodes are coupled to a flexible wiring member 15.

In the liquid discharge head 404 thus configured, for example, as the voltage applied to the piezoelectric element 12A is lowered from a reference potential, the piezoelectric element 12A contracts. Accordingly, the vibration portion 30 of the diaphragm member 3 moves down in FIG. 3, and the volume of the individual liquid chamber 6 increases. Thus, the piezoelectric element 12A generates pressure to cause the liquid to flow into the individual liquid chamber 6.

When the voltage applied to the piezoelectric element 12A is raised, the piezoelectric element 12A expands in the direction of lamination. The vibration portion 30 of the diaphragm member 3 deforms in a direction toward the nozzle 4 and reduces the volume of the individual liquid chambers 6. Thus, the piezoelectric element 12A generates pressure to squeeze the liquid out the individual liquid chambers 6 from the nozzle 4.

When the voltage applied to the piezoelectric element 12A is returned to the reference potential, the vibration portion 30 of the diaphragm member 3 is returned to the initial position. Accordingly, the individual liquid chamber 6 expands to generate a negative pressure, thus replenishing the individual liquid chamber 6 with the liquid from the common chamber 10. After the vibration of a meniscus surface of the nozzle 4 decays to a stable state, the liquid discharge head 404 shifts to the discharge of a next droplet.

Note that the driving method of the liquid discharge head 404 is not limited to the above-described example (pull-push discharge). For example, pull discharge or push discharge may be performed in response to the manner of application of the drive waveform. In the description above, a laminated piezoelectric element is used as the pressure generator for applying fluctuations in pressure to the individual liquid chamber 6. Alternatively, aspects of the present disclosure can adapt to use of a thin film piezoelectric element. Yet alternatively, a heat element can be disposed in the individual liquid chamber 6 to generate bubbles by heat of the heat element to cause pressure fluctuation. Yet alternatively, an electrostatic force can be used to cause pressure fluctuation.

Next, circulation of liquid in the liquid discharge head 404 will be described.

As illustrated in FIG. 4, at the end of the common-chamber substrate 20, the supply port 71 communicating with the common chamber 10 and the circulation port 81 communicating with the common circulation chamber 50 are disposed. The supply port 71 and the circulation port 81 are respectively coupled to the supply tank 502 and the circulation tank 503 (see FIG. 3) that store the liquid through a tube 456 (FIG. 1). The liquid stored in the supply tank 502 is supplied to the individual liquid chambers 6 via the supply port 71, the common chamber 10, the liquid introduction portion 8, and the fluid restrictor 7.

While the liquid inside the individual liquid chamber 6 is discharged from the nozzle 4 by driving of the piezoelectric element 12, the liquid not discharged but staying in the individual liquid chamber 6 is either partially or entirely circulated, through the fluid restrictor 51, the circulation channel 52 and 53, the common circulation chamber 50, and the circulation port 81, to the circulation tank 503.

Note that the liquid can be circulated not only during operation of the liquid discharge head 404 but also during the suspension of the operation. Circulation during the suspension of operation can reduce agglomeration and sedimentation of components of the liquid while constantly refreshing the liquid in the individual liquid chambers 6.

Thus, with the liquid discharge head 404, the liquid discharge apparatus 400 can reliably form a high-quality image.

A hardware configuration of the liquid discharge apparatus 400 is described below.

Figure 10:
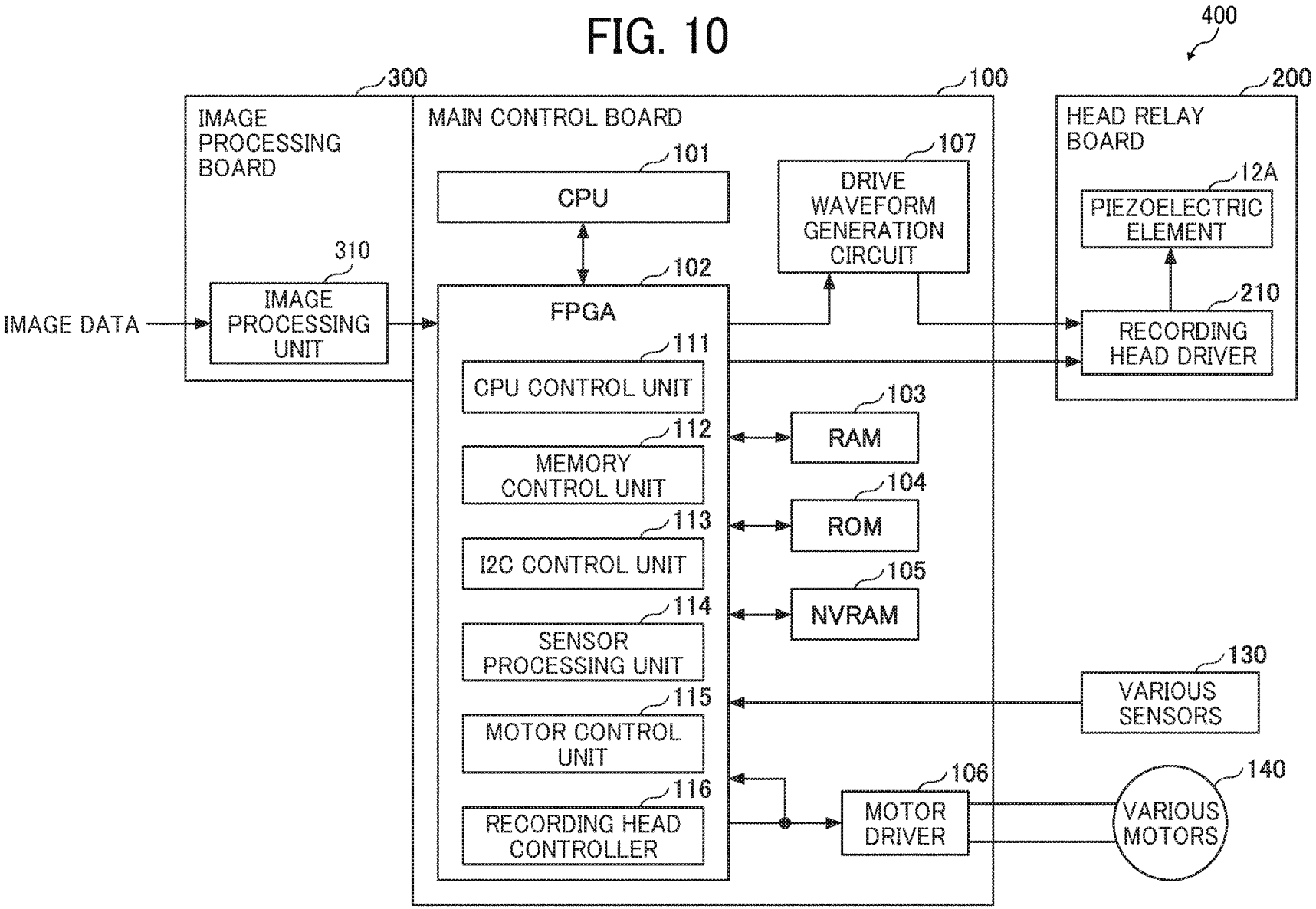
FIG. 10 is a block diagram illustrating an example of a hardware configuration of the liquid discharge apparatus.

FIG. 10 is a block diagram illustrating the hardware configuration example of the liquid discharge apparatus 400. The liquid discharge apparatus 400 includes a main control board 100, a head relay board 200, and an image processing board 300. On the head relay board 200, a recording head driver 210 to drive the piezoelectric elements 12A is mounted.

On the main control board 100, a central processing unit (CPU) 101, a field-programmable gate array (FPGA) 102, a random access memory (RAM) 103, a read only memory (ROM) 104, a non-volatile random access memory (NVRAM) 105, a motor driver 106, a drive waveform generation circuit 107, and the like are mounted.

The CPU 101 controls the entire liquid discharge apparatus 400. For example, the CPU 101 uses the RAM 103 as a work area to execute various control programs stored on the ROM 104 in order to output a control command to control each operation in the liquid discharge apparatus 400. At this time, while communicating with the FPGA 102, the CPU 101 cooperates with the FPGA 102 to control various operations in the liquid discharge apparatus 400.

The FPGA 102 includes a CPU control unit 111, a memory control unit 112, an inter-integrated circuit (I2C) control unit 113, a sensor processing unit 114, a motor control unit 115, and a recording head controller 116.

The CPU control unit 111 functions to communicate with the CPU 101. The memory control unit 112 functions to access the RAM 103 and the ROM 104. The I2C control unit 113 functions to communicate with the NVRAM 105.

The sensor processing unit 114 processes sensor signals from various sensors 130. The term "various sensors 130" is a generic term representing sensors that detect various states in the liquid discharge apparatus 400. In addition to an encoder sensor, the various sensors 130 includes a sheet sensor to detect the passage of the sheet 410, a cover sensor to detect opening of the cover 29, a temperature and humidity sensor to detect ambient temperature and humidity, a sensor to detect the state of a lever to secure the sheet 410, and an ink amount sensor to detect the amount of ink remaining in the supply tank 502. Note that an analog sensor signal output from the temperature and humidity sensor or the like is converted into a digital signal by an analog-to-digital (AD) converter mounted, for example, on the main control board 100 and input to the FPGA 102.

The motor control unit 115 controls various motors 140. The term "various motors 140" is a generic term representing motors included in the liquid discharge apparatus 400. The various motors 140 includes the main scanning motor 405 to drive the carriage 403, the sub-scanning motor 416 to convey the sheet 410 in the sub-scanning direction, a sheet feeding motor to feed the sheet 410, and a maintenance motor to drive the maintenance unit 420.

Descriptions are given below of control of the main scanning motor 405, as an example control by cooperation between the CPU 101 and the motor control unit 115 of the FPGA 102. First, the CPU 101 notifies the motor control unit 115 of an instruction to start operation of the main scanning motor 405 and the travel speed and the travel distance of the carriage 403. In response to a reception of such an instruction, the motor control unit 115 generates a drive profile, based on the travel speed and information on the operation start instruction notified from the CPU 101, calculates a pulse-width modulation (PWM) command value while performing comparing with an encoder value supplied from the sensor processing unit 114 (obtained from processing of the sensor signal from the encoder sensor), and outputs the PWM command value to the motor driver 106. Upon completion of the predetermined operation, the motor control unit 115 notifies the CPU 101 of the completion of the operation. Although the description above concerns the example in which the motor control unit 115 generates the drive profile, alternatively, the CPU 101 can be configured to generate the drive profile and transmits an instruction to the motor control unit 115. Further, the CPU 101 counts the number of printed sheets, the number of scanning of the main scanning motor 405, and the like.

The recording head controller 116 transmits a drive waveform, which is stored in the ROM 104 (a waveform data memory), a discharge synchronization signal LINE, and a discharge timing signal CHANGE to the drive waveform generation circuit 107 to cause the drive waveform generation circuit 107, to generate a common drive waveform signal Vcom. More specifically, the ROM 104 serving as the waveform data memory stores a plurality of drive waveform data (including discharge drive waveform data and micro-vibration drive waveform data) for generating a common drive waveform Vcom1 (to be described later) to be used for a printing area (a printable area) and a common drive waveform Vcom2 to be used for a non-print area. The common drive waveform signal Vcom generated by the drive waveform generation circuit 107 is input to the recording head driver 210 mounted on the head relay board 200.

The image processing board 300 includes an image processing unit 310. The image processing unit 310 performs gradation processing, image conversion processing, and the like on the received image data and converts the received image data into image data in a format that can be processed by the recording head controller 116. Then, the image processing unit 310 outputs the converted image data to the recording head controller 116.

Figure 11:
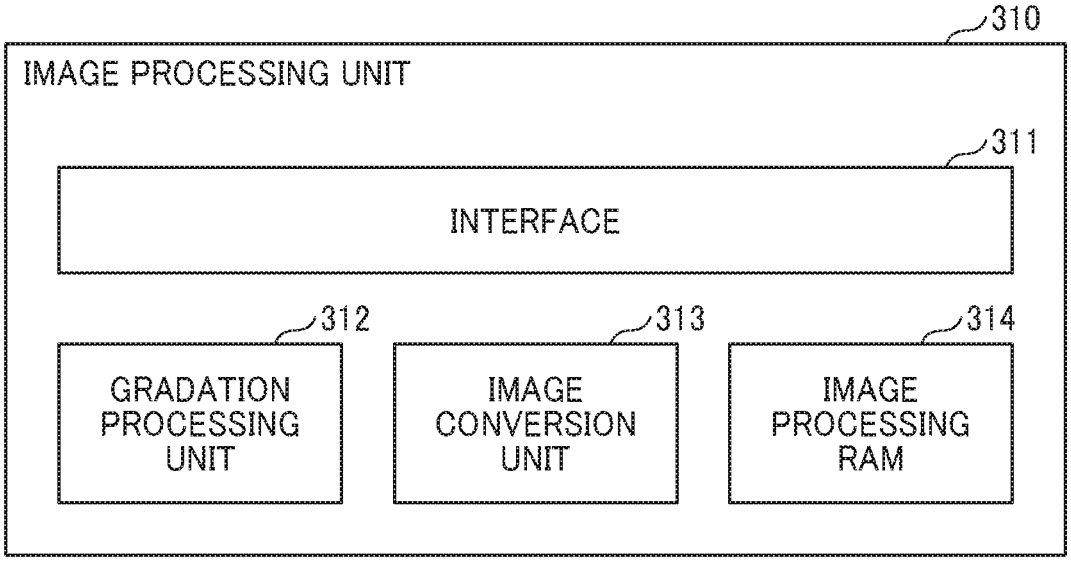
FIG. 11 is a block diagram illustrating an example configuration of an image processing unit of the liquid discharge apparatus.

FIG. 11 is a block diagram illustrating an example configuration of the image processing unit 310.

More specifically, the image processing unit 310 includes an interface 311, a gradation processing unit 312, an image conversion unit 313, and an image processing RAM 314.

The interface 311 is an input unit of image data and is a communication interface with the CPU 101 and the FPGA 102. The gradation processing unit 312 performs gradation processing on accepted multivalued image data and converts the image data into small-value image data. The small-value image data is image data of a gradation number equal to the type (large droplet, medium droplet, and small droplet) of the droplets discharged by the liquid discharge head 404. Then, the gradation processing unit 312 holds the converted image data for one band or more on the image processing RAM 314.

The image data for one band represents image data corresponding to the maximum width in the sub-scanning direction that the liquid discharge head 404 can record in one scanning in the main scanning direction.

The image conversion unit 313 converts the image data of one band on the image processing RAM 314 in a unit of one image to be output in one scanning in the main scanning direction. This conversion is performed in accordance with the configuration of the liquid discharge head 404, according to the information of the printing order and the printing width (the width of image recording per scanning in the sub-scanning direction) received from the CPU 101 via the interface 311.

The printing order and the printing width can be one-pass printing in which an image is formed in one scanning in the main scanning direction on the recording medium, or, alternatively, multi-pass printing in which an image is formed in a plurality of times of scanning in the main scanning direction in the same area of the recording medium using the same nozzle group or different nozzle groups. Alternatively, a plurality of heads can be arrayed in the main scanning direction to discharge liquid to the same area with different nozzles. These recording methods can be appropriately combined.

The term "printing width" is the width in the sub-scanning direction of the image to be recorded while the liquid discharge head 404 performs one scanning in the main scanning direction. In the present embodiment, the CPU 101 sets the printing width.

The image conversion unit 313 outputs converted image data SD' to the image processing RAM 314 via the interface 311.

The function of the image processing unit 310 can be executed by hardware such as an FPGA or ASIC or by an image processing program stored in a memory inside the image processing unit 310.

In addition, the function of the image processing unit 310 can be implemented not by an internal configuration of the liquid discharge apparatus 400 but by software installed on a computer.

Next, the recording head controller 116, the drive waveform generation circuit 107, and the recording head driver 210 will be described.

Figure 12:
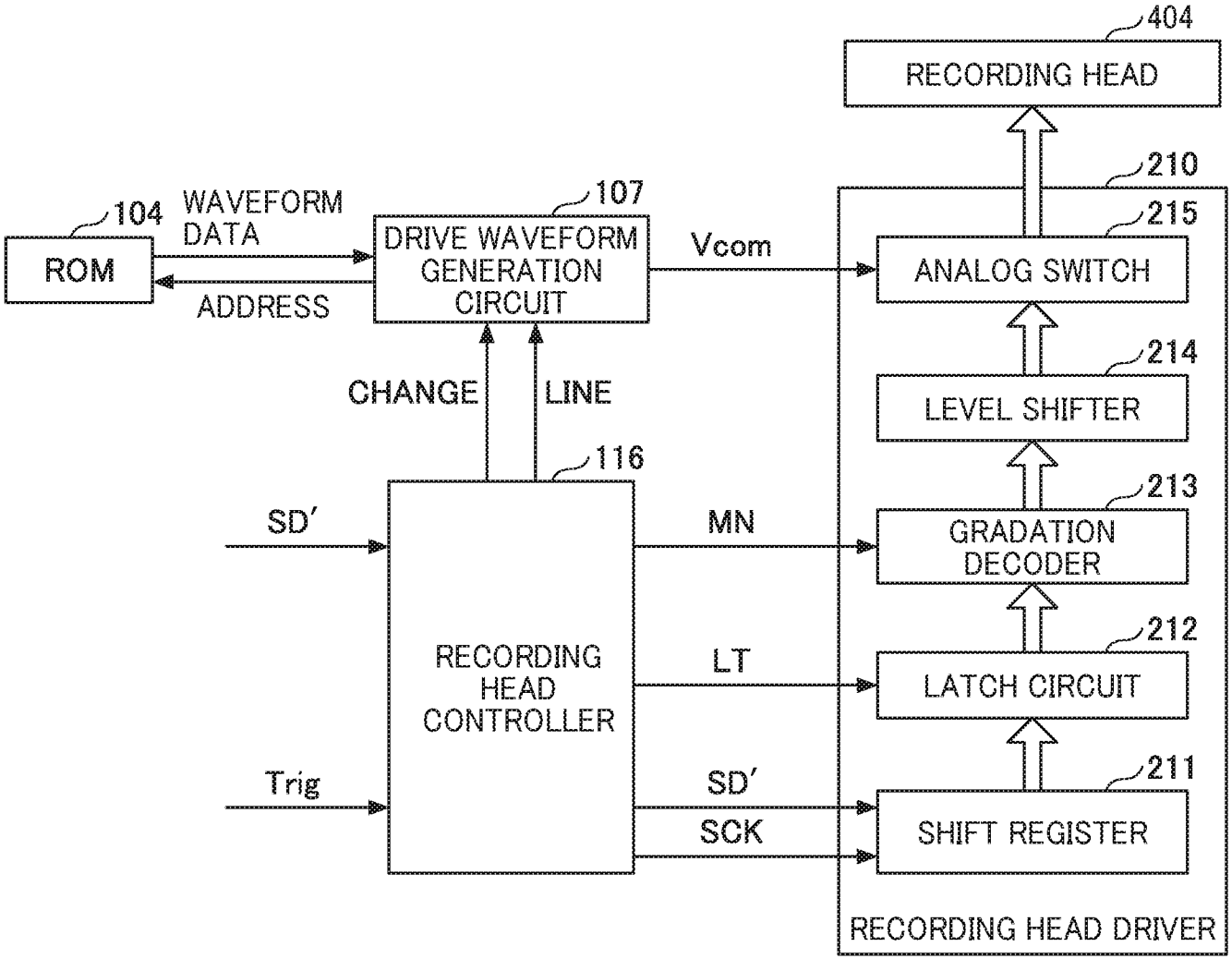
FIG. 12 is a block diagram illustrating example configurations of a recording head controller, a drive waveform generation circuit, and a recording head driver of the liquid discharge apparatus.

FIG. 12 is a block diagram illustrating an example configuration of the recording head controller 116, the drive waveform generation circuit 107, and the recording head driver 210.

As illustrated in FIG. 12, in response to a reception of a trigger signal Trig that triggers liquid discharging, the recording head controller 116 outputs the discharge synchronization signal LINE that triggers generation of the drive waveform, to the drive waveform generation circuit 107. Further, the recording head controller 116 outputs the discharge timing signal CHANGE equivalent to the amount of delay from the discharge synchronization signal LINE, to the drive waveform generation circuit 107.

The drive waveform generation circuit 107 (a drive waveform generation unit) generates the common drive waveform signal Vcom at the timing based on the discharge synchronization signal LINE and the discharge timing signal CHANGE. More specifically, the drive waveform generation circuit 107 generates the common drive waveform Vcom1 used for the printing area and the common drive waveform Vcom2 used for the non-print area.

Further, the recording head controller 116 receives the image data SD' after the image processing from the image processing unit 310 on the image processing board 300. Based on the image data SD', the recording head controller 116 generates a mask control signal MN. The mask control signal MN is for selecting a waveform of the common drive waveform signal Vcom according to the size of the ink droplet to be discharged from each nozzle 4 of the liquid discharge head 404. The mask control signal MN is a signal synchronized with the discharge timing signal CHANGE. Then, the recording head controller 116 transmits the image data SD', a synchronization clock signal SCK, a latch signal LT instructing latch of the image data, and the generated mask control signal MN to the recording head driver 210.

As illustrated in FIG. 12, the recording head driver 210 includes a shift register 211, a latch circuit 212, a gradation decoder 213, a level shifter 214, and an analog switch 215.

The shift register 211 receives the image data SD' and the synchronization clock signal SCK transmitted from the recording head controller 116. The latch circuit 212 latches each value on the shift register 211 according to the latch signal LT transmitted from the recording head controller 116.

The gradation decoder 213 decodes the value (image data SD') latched by the latch circuit 212 and the mask control signal MN and outputs the result. The level shifter 214 converts the level of a logic level voltage signal of the gradation decoder 213 to a level at which the analog switch 215 can operate.

The analog switch 215 is turned on and off by the output received from the gradation decoder 213 via the level shifter 214. The analog switch 215 is provided for each nozzle 4 of the liquid discharge head 404 and is coupled to an individual electrode of the piezoelectric element 12A corresponding to each nozzle 4.

In addition, to the analog switch 215, the common drive waveform signal Vcom from the drive waveform generation circuit 107 is input. In addition, as described above, the timing of the mask control signal MN is synchronized with the timing of the common drive waveform signal Vcom. Therefore, the analog switch 215 is switched between on and off timely in accordance with the output from the gradation decoder 213 via the level shifter 214. With this operation, the waveform to be applied to the piezoelectric element 12A corresponding to each nozzle 4 is selected from the drive waveforms forming the common drive waveform signal Vcom. As a result, the size of the ink droplet discharged from the nozzle 4 is controlled. That is, the recording head driver 210 functions as a drive control unit that applies, to the piezoelectric element 12A, a drive waveform for changing the volume of the individual liquid chamber 6.

In addition, in the liquid discharge apparatus 400 according to the present embodiment, the meniscus is slightly vibrated to such degree that liquid is not discharged therefrom to protect the meniscus from drying. These will be explained below.

Figure 13:
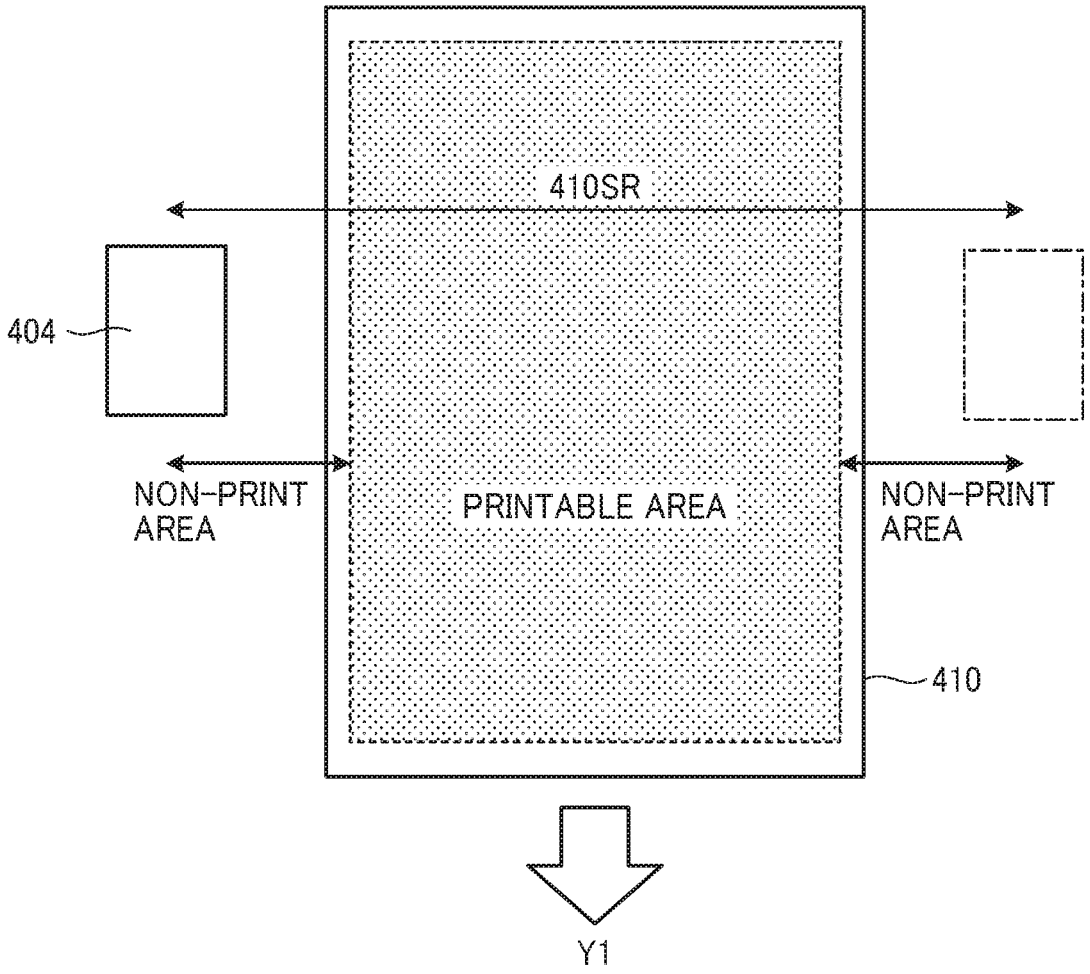
FIG. 13 is a plan view illustrating an example of a scanning range of the liquid discharge head in the liquid discharge apparatus according to Embodiment 1.

FIG. 13 is a diagram illustrating an example of a scanning range of the liquid discharge head 404 in the liquid discharge apparatus 400. In FIG. 13, the liquid discharge head 404 (the carriage 403) is movable in a range 410SR in the direction perpendicular to the direction of conveyance of the sheet 410 indicated by arrow Y1. That is, the range 410SR is the scanning range (a head movable range) on the sheet 410. As described above, to the liquid discharge head 404, the tube 456 for ink circulation is coupled, and the liquid discharge head 404 is configured such that ink passes in the vicinity of the nozzles 4 (an individual liquid chamber circulation type).

As illustrated in FIG. 13, the scanning range (the head movable range), in which the liquid discharge head 404 (the carriage 403) can scan the sheet 410, includes a printable area (the printing area) in which printing on the sheet 410 can be performed and an area (the non-print area) outside the printing area in the scanning range of the liquid discharge head 404. The non-print area is an area where the image data SD' does not exist.

Figure 14A:
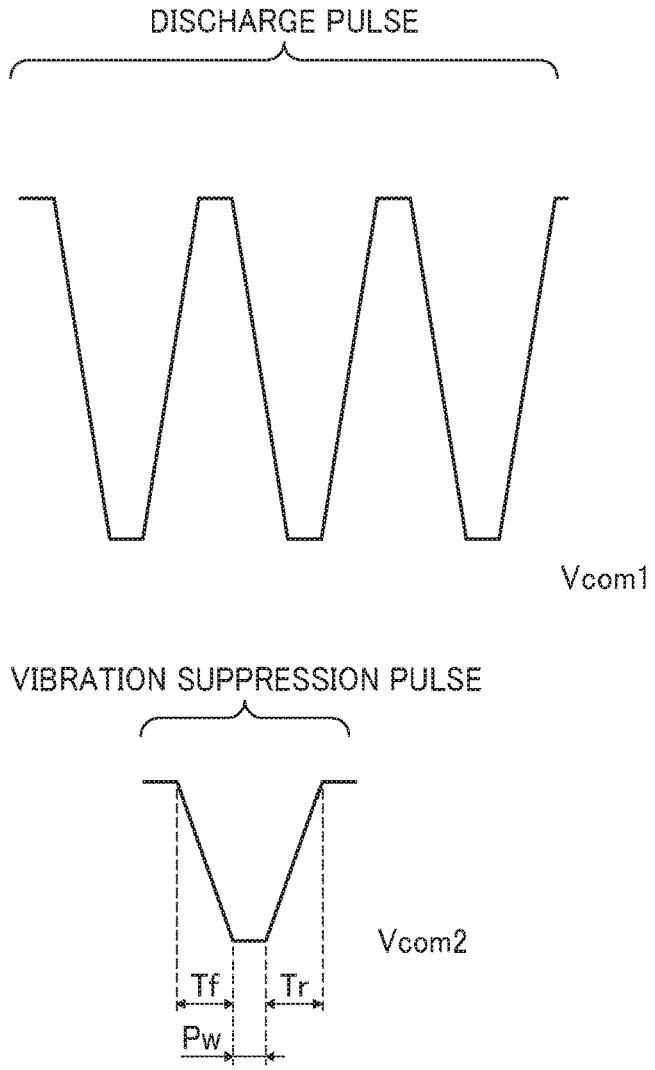
FIG. 14A is a diagram illustrating an example of a drive waveform.

FIG. 14A is a diagram illustrating an example of the drive waveform. According to the present embodiment, as illustrated in FIG. 14A, in the non-print area, the drive waveform generation circuit 107 generates a micro-vibration drive waveform (a vibration suppressing pulse) Vcom2 that gives the meniscus a weak vibration enough to shake the meniscus, to draw in the meniscus. In addition, in the printing area, the drive waveform generation circuit 107 generates a drive waveform Vcom1 (a discharge pulse) in which no micro-vibration drive waveform (vibration suppressing pulse) is on the common drive waveform, for discharging liquid droplets to form an image.

As illustrated in FIG. 14A, the micro-vibration drive waveform (vibration suppressing pulse) includes a voltage change time Tf (a meniscus drawing-in time) during which the voltage is changed to draw in the meniscus, a voltage maintaining time Pw during which the voltage is maintained, and a voltage change time Tr (a meniscus returning time) during which the voltage is changed to return the meniscus.

Making the initial voltage of the discharge drive waveform (discharge pulse) identical to the initial voltage of the micro-vibration drive waveform (vibration suppressing pulse) is advantageous because there is no need to secure a time for voltage change at the time of switching the waveform from the micro-vibration drive waveform (vibration suppressing pulse) used outside the printing area to the discharge drive waveform (discharge pulse) used in the printing area. Accordingly, the drive waveform can be controlled more efficiently.

An ink droplet (liquid droplet) can be effectively discharged at a low voltage, under conditions:

Tf and Tr are shorter than Tc/2; and

Tf+Pw is closer to Tc/2, where Tc represents a natural oscillation period of the meniscus, Tf represents a voltage change time during which the voltage is changed to draw in the meniscus (a meniscus drawing-in time), Pw represents a time during which the voltage is maintained, and Tr represents a voltage change time during which the voltage is changed to return the meniscus (a meniscus returning time).

However, when the waveform is used as a micro-vibration drive waveform (a vibration suppressing pulse), the efficiency decreases as the voltage change times Tf and Tr become longer than Tc/2. Then, the voltage becomes higher. In particular, when the voltage change times Tf and Tr become longer than the natural oscillation period Tc, the voltage changes cancel excitation of natural vibration period caused thereby with each other. Therefore, the voltage can be further increased, the meniscus can be significantly drawn in, and the stirring efficiency of the meniscus can be enhanced.

Figure 14B:
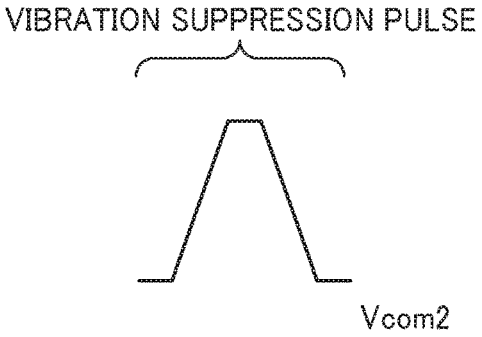
FIG. 14B is a diagram illustrating a modified example of the drive waveform.

Note that, in the present embodiment, the micro-vibration drive waveform (vibration suppressing pulse) Vcom2 has been described as the waveform for drawing in the meniscus, but the vibration suppressing pulse is not limited thereto. FIG. 14B is a diagram illustrating a modified example of the drive waveform. As illustrated in FIG. 14B, the micro-vibration drive waveform (vibration suppressing pulse) Vcom2 can be a waveform that pushes out the meniscus.

FIGS. 15A to 17B are graphs illustrating speed and the amount of change of the meniscus as results of simulation in which the voltage change times Tf and Tr are changed. In FIG. 15A to FIG. 17B, the voltage is set to 2.7 V.

Figure 15A:
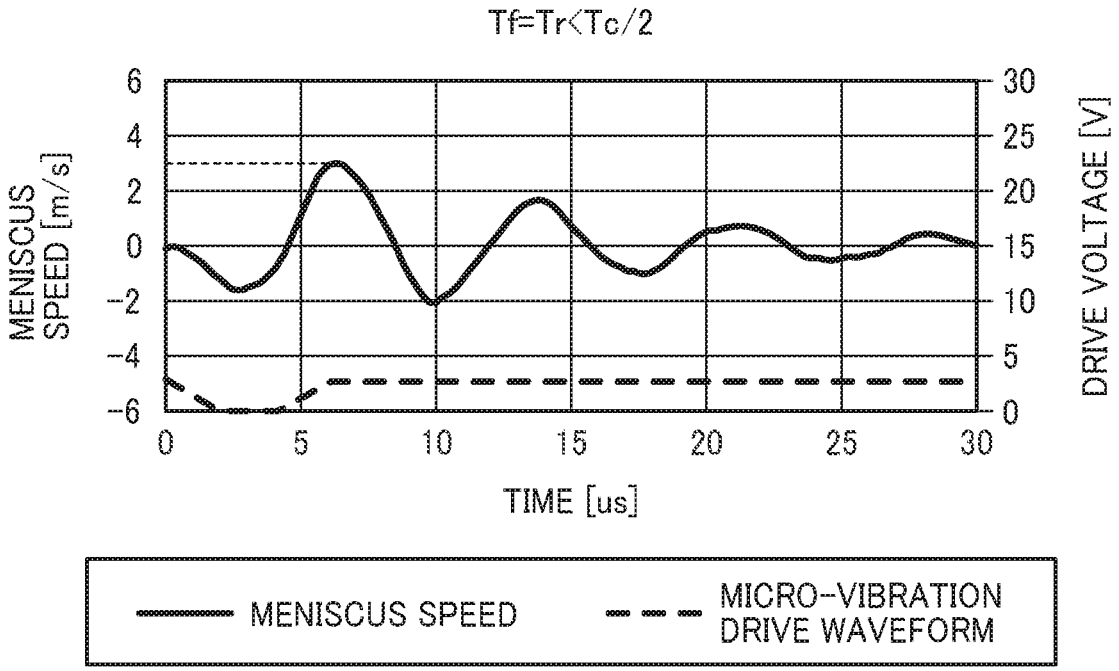
FIGS. 15A and 15B are graphs illustrating speed and change amount of a meniscus as results of a simulation.
Figure 15B:
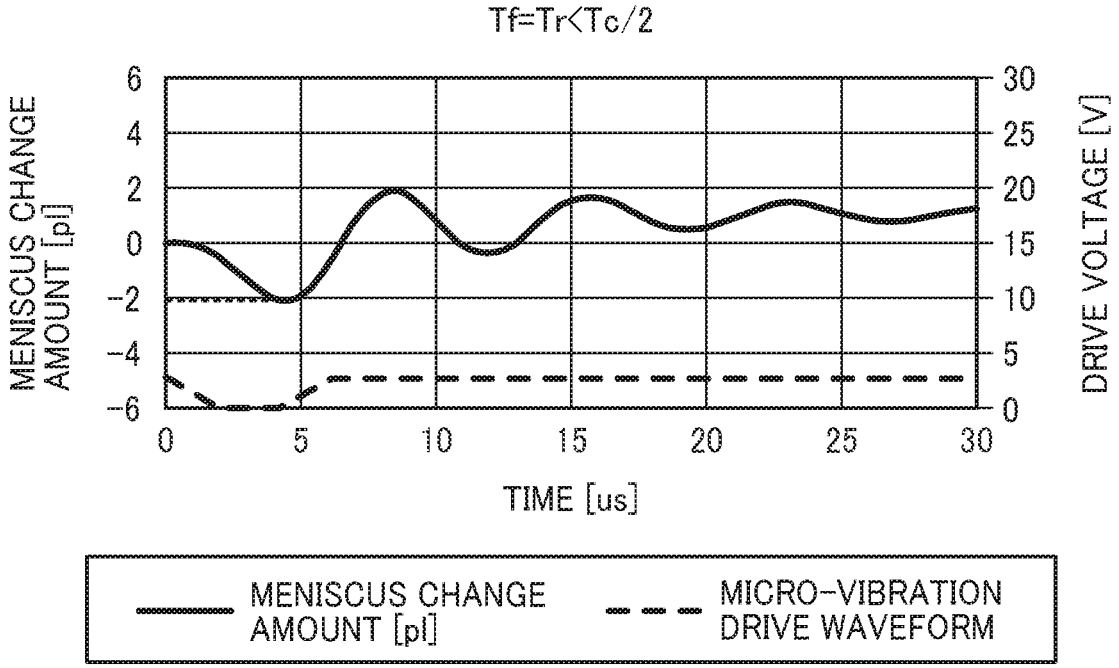

FIGS. 15A and 15B illustrate results in an example where the voltage change times Tf and Tr are shorter than Tc/2. As illustrated in FIG. 15A, the meniscus speed is 3 m/s in the case where the micro-vibration drive waveform (suppressing pulse) is set not to cause the droplet to fly. For the purpose of preventing droplets from flying, the maximum positive value is adopted. Further, as illustrated in FIG. 15B, the meniscus change amount is −2 pl in the case where the micro-vibration drive waveform is set not to cause the droplet to fly. From the purpose of observing the amount by which the meniscus is drawn in, the maximum negative value is adopted. In the example illustrated in FIGS. 15A and 15B, in which the voltage change times Tf and Tr are shorter than Tc/2, the nozzle is efficiently driven and it can be known that the meniscus significantly vibrates.

Figure 16A:
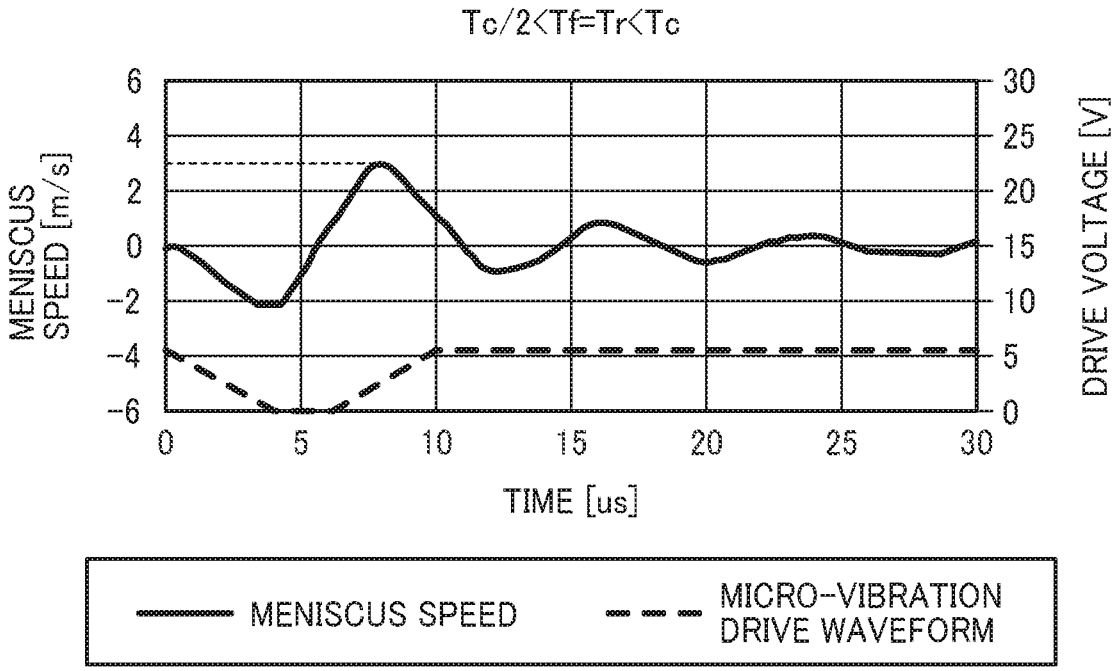
FIGS. 16A and 16B are graphs illustrating speed and change amount of the meniscus as results of another simulation.
Figure 16B:
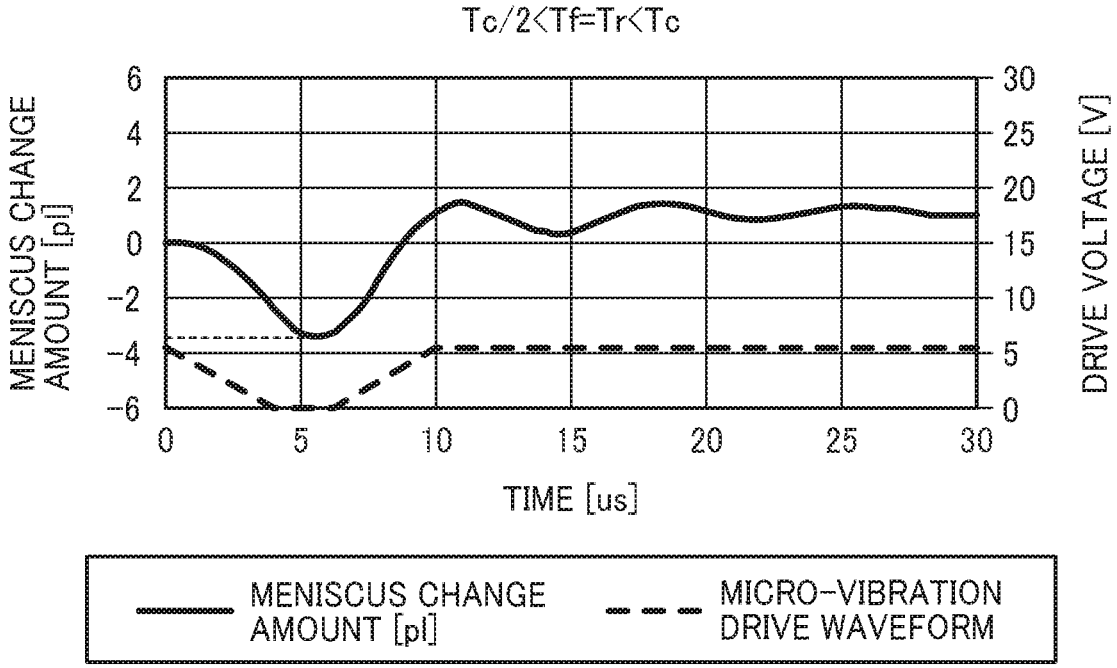

In the example illustrated in FIGS. 16A and 16B, the voltage change times Tf and Tr are longer than Tc/2 and shorter than the natural oscillation period Tc. In the example illustrated in FIGS. 16A and 16B, the meniscus speed is 3 m/s, but the meniscus change amount increases to about −3.4 pl. In the example illustrated in FIGS. 16A and 16B, in which the voltage change times Tf and Tr are longer than Tc/2 and shorter than the natural oscillation period Tc, the vibration of the meniscus is smaller than that in FIGS. 15A and 15B. In other words, the voltage can be made higher in order to obtain the same meniscus speed as in FIGS. 15A and 15B.

As described above, when the voltage change time Tf for drawing in the meniscus is equal to or longer than the half the natural vibration period Tc of the meniscus (TF≥Tc/2), excitation of natural vibration can be suppressed. Accordingly, the voltage to draw in the meniscus for preventing ink discharge can be increased, and the meniscus can be effectively stirred to inhibit thickening of the ink.

Figure 17A:
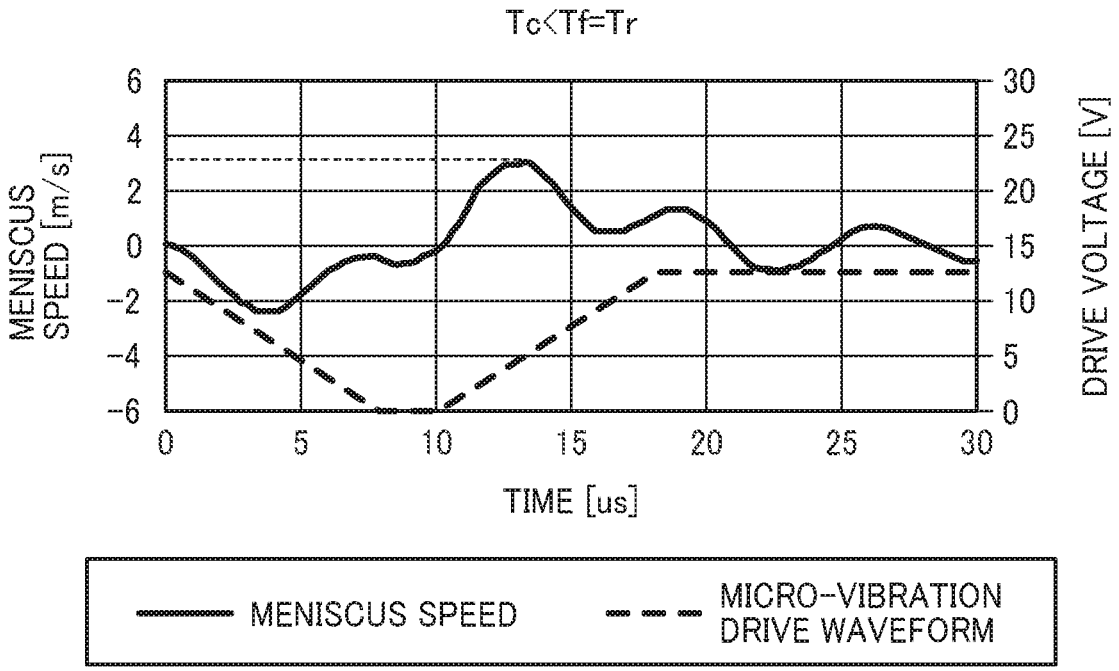
FIGS. 17A and 17B are graphs illustrating speed and change amount of the meniscus as results of another simulation.
Figure 17B:
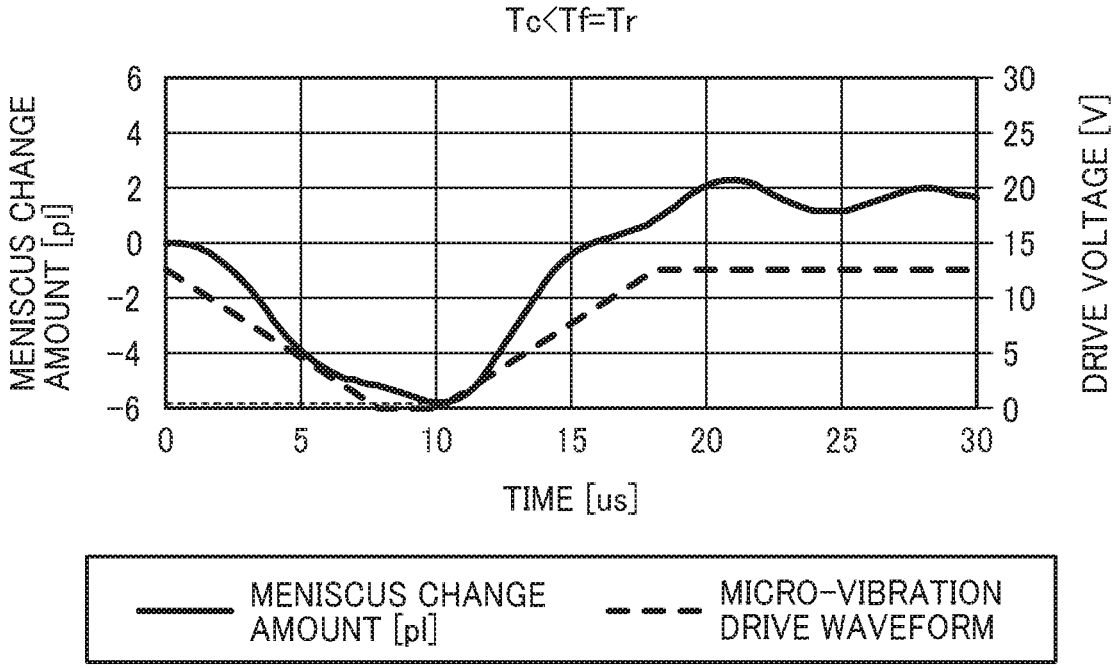

In the example illustrated in FIGS. 17A and 17B, the voltage change times Tf and Tr are longer than the natural oscillation period Tc. In the example illustrated in FIGS. 17A and 17B, the meniscus speed is 3 m/s, but the meniscus change amount increases to about −5.7 pl. In the example illustrated in FIGS. 17A and 17B, in which the voltage change times Tf and Tr are made longer than the natural oscillation period Tc, unlike the example illustrated in FIGS. 15A and 16B and that in FIGS. 16A and 16B, almost no natural vibration is observed. Thus, when the voltage change times Tf and Tr are made longer than the natural oscillation period Tc, the voltage can be further increased and the meniscus can be significantly shaken.

Accordingly, when the voltage change time is not shorter than the natural oscillation period Tc, excitation of the natural vibration can be further inhibited. Therefore, the meniscus can be drawn in more significantly. Similarly, when the voltage change time Tr for returning the meniscus is not shorter than Tc/2, or not shorter than the natural oscillation period. Tc, the meniscus can be drawn in more significantly.

As described above, according to the present embodiment, the ink in the vicinity of the nozzle 4 is circulated, thereby preventing thickening of the ink in the nozzle 4. Simultaneously, outside the printing area, the meniscus is shaken to such a degree that the ink is not discharged, thereby resetting the thickening at the meniscus surface. Accordingly, such configuration can obviate addition of a micro-vibration drive waveform (a vibration suppressing pulse) to the drive waveform for the printing area while preventing discharge defect in consecutive printing. Accordingly, the drive waveform for image formation can be shortened in waveform length, and the discharge frequency for image formation can be increased. Thus, meniscus viscosity can be inhibited, and printing speed can be improved.

In the liquid discharge apparatus 400, meniscus thickening can be effectively prevented by increasing the flow rate of the liquid (ink) to the liquid discharge head 404 in low humidity environments or hot environments, in which the meniscus easily dries. For example, a manufacturer of the liquid discharge apparatus 400 stores, in the ROM 104, a table empirically associating a humidity with flow rate setting and a temperature with flow rate setting in advance, and the recording head controller 116 changes the flow rate in response to a detection result by the temperature and humidity sensor (of the various sensors 130), with reference to the table.

Additionally, in the liquid discharge apparatus 400, meniscus thickening can be effectively prevented by increasing the number of times of micro vibrations caused by the micro-vibration drive waveform (vibration suppressing pulse) in low humidity environments or hot environments, in which the meniscus easily dries. For example, the manufacturer of the liquid discharge apparatus 400 stores, in the ROM 104, a table empirically associating a humidity with the number of times of micro vibrations and a temperature with the number of times of micro vibrations in advance, and the recording head controller 116 changes the number of times of micro vibrations in response to a detection result by the temperature and humidity sensor (of the various sensors 130), with reference to the table.

In the present disclosure, the "liquid discharge head" refers to a functional component configured to discharge liquid from a nozzle.

The liquid to be discharged from the nozzle of the liquid discharge head is not limited to a particular liquid as long as the liquid has a viscosity or surface tension to be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs an electrothermal transducer element, such as a heat element, and an electrostatic actuator including a diaphragm and opposed electrodes.

The term "liquid discharge device" represents a structure including the liquid discharge head and a functional part(s) or mechanism combined thereto. That is, "liquid discharge device" is an assembly of parts relating to liquid discharge. For example, the "liquid discharge device" or "liquid discharge unit" can include a combination of the liquid discharge head with at least one of a supply and circulation system, a carriage, a maintenance unit, and a main-scan moving unit.

Herein, the terms "combined" or "integrated" mean attaching the liquid discharge head and the functional parts (or mechanism) to each other by fastening, screwing, binding, or engaging and holding one of the liquid discharge head and the functional parts to the other movably relative to the other. The liquid discharge head may be detachably attached to the functional part(s) or unit(s).

Examples of the liquid discharge device further include a unit in which the liquid discharge head is combined with the supply and circulation system. In this case, the liquid discharge head and the supply and circulation system may be coupled to each other with a tube. Furthermore, a unit including a filter can be added at a position between the supply and circulation system and the liquid discharge head of the liquid discharge device.

In yet another example, the liquid discharge head and the carriage can be combined as "liquid discharge device".

As yet another example, the liquid discharge device is a unit in which the liquid discharge head and the main scanning moving unit are combined into a single unit. The liquid discharge head is movably held by a guide that is a part of the main scanning moving unit.

As yet another example, the liquid discharge device is a unit in which a cap that is a part of the maintenance unit is secured to the carriage mounting the liquid discharge head so that the liquid discharge head, the carriage, and the maintenance unit are combined as a single unit.

Further, in another example, a tube is coupled to the liquid discharge head mounting either the supply and circulation system or the channel member so that the liquid discharge head and the supply and circulation system are combined into a liquid discharge device. Through this tube, the liquid stored in a liquid container is supplied to the liquid discharge head.

The main-scan moving unit may be a guide only. The supply unit may be a tube only or a loading portion only.

In the present disclosure, the term "liquid discharge apparatus" includes a liquid discharge head or a liquid discharge device (unit) and drives the liquid discharge head to discharge liquid. The term "liquid discharge apparatus" used here includes, in addition to apparatuses to discharge liquid to materials to which the liquid can adhere, apparatuses to discharge the liquid into gas (air) or liquid.

The liquid discharge apparatus can also include devices to feed, convey, and discharge the material onto which liquid adheres. The liquid discharge apparatus can further include a pretreatment apparatus to apply treatment liquid to the material before liquid is discharged onto the material and a post-treatment apparatus to apply treatment liquid to the material after liquid is discharged onto the material.

As the liquid discharge apparatuses, for example, there are image forming apparatuses to discharge ink onto sheets to form images and three-dimensional fabricating apparatuses to discharge molding liquid to a powder layer in which powder is molded into a layer-like shape, so as to form three-dimensional fabricated objects.

The term "liquid discharge apparatus" is not limited to an apparatus to discharge liquid to visualize meaningful images, such as letters or figures. For example, the liquid discharge apparatus can be an apparatus to form meaningless images, such as meaningless patterns, or fabricate meaningless three-dimensional images.

The above-mentioned term "material to which liquid can adhere" represents a material which liquid can, at least temporarily, adhere to and solidify thereon, or a material into which liquid permeates. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

The above-mentioned "material to which liquid adheres" may be any material, such as paper, thread, fiber, cloth, leather, metal, plastic, glass, wood, ceramics, or the like, as long as liquid can temporarily adhere.

Further, the term "liquid" includes any liquid having a viscosity or a surface tension that can be discharged from the head. The "liquid" is not limited to a particular liquid and may be any liquid having a viscosity or a surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

The "liquid discharge apparatus" can be an apparatus in which the liquid discharge head and a material to which liquid can adhere move relatively to each other. However, the liquid discharge apparatus is not limited to such an apparatus. For example, the liquid discharge apparatus can be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat, with the treatment liquid, a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein are synonymous with each other.

Embodiment 2

Next, Embodiment 2 is described.

Although Embodiment 1 is described above using the serial-type image recording apparatus, Embodiment 2 concerns a line-type image recording apparatus. In the following, descriptions of the configurations similar to those in Embodiment 1 will be omitted, and features of Embodiment 2 different from Embodiment 1 will be described.

Figure 18:
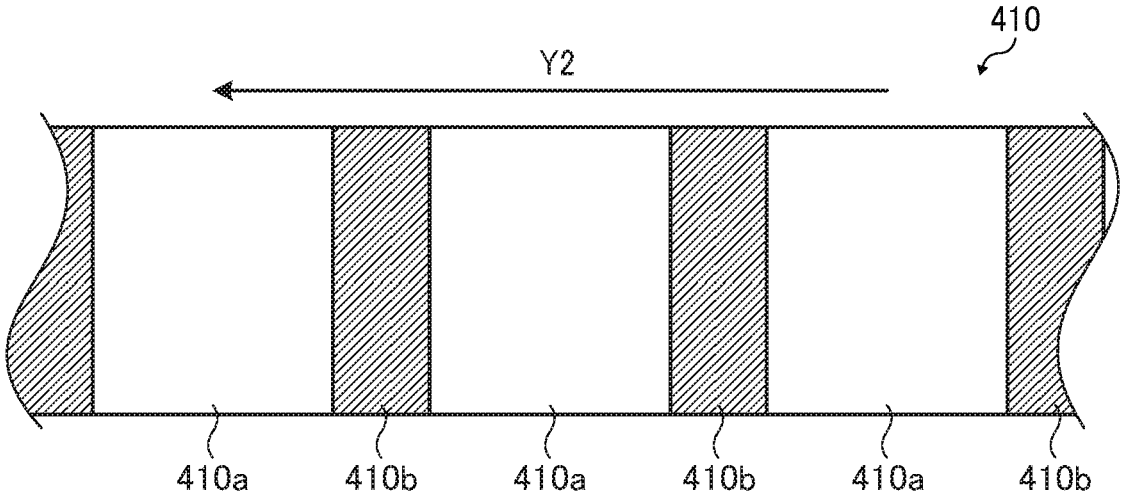
FIG. 18 is a diagram illustrating an example of a scanning range of a liquid discharge head in a liquid discharge apparatus according to Embodiment 2.

FIG. 18 is a diagram illustrating an example of a scanning range of the liquid discharge head 404 of the liquid discharge apparatus 400 according to Embodiment 2. FIG. 18 illustrates the sheet 410 conveyed in a line-type image recording apparatus. In FIG. 18, the sheet 410 includes printing areas 410*a* and non-print areas 410*b*.

Also in the liquid discharge apparatus that is such a line-type image recording apparatus, as illustrated in FIG. 14A and the like, the drive waveform generation circuit 107 generates, in the non-print areas 410*b*, a drive waveform with which the meniscus is slightly vibrated and generates, in the printing areas 410*a*, a drive waveform (a discharge pulse) for discharging liquid droplets to form an image.

As described above, according to the present embodiment, the discharge frequency for image formation can be increased, increases in viscosity of the meniscus can be inhibited, and high-quality images can be formed at high speed.

Although the descriptions above concern examples in which the liquid discharge apparatus adopting the aspects of this disclosure is a printer, the liquid ejecting apparatus according to the present disclosure can be other image forming apparatus types, such as multifunction peripheral (MFP) having at least two of printing, facsimile transmission, copying, and scanning functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge device comprising:

a liquid discharge head having a range of movement outside of a printable area, the liquid discharge head including:

a plurality of liquid chambers communicating with a plurality of nozzles, respectively, the plurality of liquid chambers through which liquid is circulated; and a pressure generator provided to each of the plurality of liquid chambers, the pressure generator configured to generate a pressure to discharge the liquid from corresponding one of the plurality of nozzles;

a waveform data memory configured to store drive waveform data, the drive waveform data including:

discharge drive waveform data for discharging, in the printable area, the liquid according to image data; and micro-vibration drive waveform data for causing, in a non-printable area, a micro vibration of a meniscus of the liquid discharge head, the non-printable area outside the printable area; and circuitry configured to:

generate a drive waveform based on the drive waveform data;

apply, to the pressure generator, a discharge drive waveform generated based on the discharge drive waveform data, in the printable area; and apply, to the pressure generator, a micro-vibration drive waveform generated based on the micro-vibration drive waveform data, in the non-printable area, wherein the micro-vibration drive waveform includes a meniscus drawing-in time during which a voltage applied to the pressure generator is changed to draw in the meniscus, the meniscus drawing-in time not shorter than Tc/2, where Tc represents a natural vibration period of the meniscus.

2. The liquid discharge device according to claim 1, wherein the meniscus drawing-in time is not shorter than the natural vibration period of the meniscus.

3. The liquid discharge device according to claim 1, wherein the micro-vibration drive waveform includes a meniscus returning time during which a voltage applied to the pressure generator is changed to return the meniscus that has been drawn in, the meniscus returning time not shorter than Tc/2, where Tc represents a natural vibration period of the meniscus.

4. The liquid discharge device according to claim 3, wherein the meniscus returning time is not shorter than the natural vibration period of the meniscus.

5. The liquid discharge device according to claim 1, wherein an initial voltage in the discharge drive waveform is same as an initial voltage in the micro-vibration drive waveform.

6. The liquid discharge device according to claim 1, wherein an initial voltage of the drive waveform is identical to an initial voltage of the micro-vibration drive waveform.

7. The liquid discharge device according to claim 1, further comprising a temperature and humidity sensor configured to detect a temperature and a humidity, wherein the circuitry is configured to set a flow rate of the liquid flowing to the liquid discharge head to an increased value in response to a detection result of the temperature and humidity sensor indicating at least one of a low humidity and a high temperature.

8. The liquid discharge device according to claim 1, further comprising a temperature and humidity sensor configured to detect a temperature and a humidity, wherein the circuitry is configured to set a number of micro vibrations by the micro-vibration drive waveform to an increased number in response to a detection result of the temperature and humidity sensor indicating at least one of a low humidity and a high temperature.

9. A liquid discharge apparatus comprising:

a conveyance device configured to convey a recording medium; and the liquid discharge device according to claim 1, configured to discharge the liquid onto the recording medium conveyed by the conveyance device, to form an image on the recording medium.

* * * * *